US011400726B2

(12) United States Patent
Oguchi et al.

(10) Patent No.: US 11,400,726 B2
(45) Date of Patent: Aug. 2, 2022

(54) PRINTING APPARATUS AND PRINTING SYSTEM

(71) Applicant: SEIKO EPSON CORPORATION, Tokyo (JP)

(72) Inventors: Ryo Oguchi, Shiojiri (JP); Yasuaki Hirai, Shiojiri (JP); Shunichi Hizawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 60 days.

(21) Appl. No.: 17/001,958

(22) Filed: Aug. 25, 2020

(65) Prior Publication Data

US 2021/0060964 A1 Mar. 4, 2021

(30) Foreign Application Priority Data

Aug. 29, 2019 (JP) ..... JP2019-156431

(51) Int. Cl.
*B41J 2/175* (2006.01)
*B41J 29/393* (2006.01)

(52) U.S. Cl.
CPC ..... *B41J 2/17546* (2013.01); *B41J 2/1752* (2013.01); *B41J 29/393* (2013.01)

(58) Field of Classification Search
CPC .... B41J 2/17546; B41J 2/1752; B41J 29/393; B41J 2/17509; B41J 29/13; B41J 2/01; B41J 2029/3937
USPC ..... 347/19
See application file for complete search history.

(56) References Cited

U.S. PATENT DOCUMENTS

| | | | | |
|---|---|---|---|---|
| 9,607,254 | B2 | 3/2017 | Kawai | |
| 9,610,767 | B2 | 4/2017 | Matsumoto et al. | |
| 10,237,451 | B2 | 3/2019 | Gondek et al. | |
| 2002/0036668 | A1 | 3/2002 | Matsumoto et al. | |
| 2003/0164988 | A1 | 9/2003 | Enomoto et al. | |
| 2006/0045595 | A1 | 3/2006 | Hanaoka | |
| 2012/0194592 | A1 | 8/2012 | Bhaumik et al. | |
| 2014/0063145 | A1* | 3/2014 | Iwamuro | B41J 2/17546 347/86 |
| 2015/0009251 | A1 | 1/2015 | Asada | |
| 2016/0292550 | A1* | 10/2016 | Kawai | G03G 15/553 |

FOREIGN PATENT DOCUMENTS

| | | |
|---|---|---|
| JP | 2002-127550 | 5/2002 |
| JP | 2004-090517 | 3/2004 |
| JP | 2017-064959 | 4/2017 |
| JP | 2017-124559 | 7/2017 |

* cited by examiner

*Primary Examiner* — Kristal Feggins
*Assistant Examiner* — Alexander D Shenderov
(74) *Attorney, Agent, or Firm* — Workman Nydegger

(57) ABSTRACT

Printing is performed with a printing material accommodated in a printing material accommodation body. Accommodation body information on the printing material accommodation body is acquired. When the accommodation body information on the printing material accommodation body is first information, an operation of a first mode is performed. Meanwhile, when the accommodation body information on the printing material accommodation body is second information, in a case in which a permission condition is satisfied according to communication with a server apparatus, an operation of a second mode is performed.

16 Claims, 10 Drawing Sheets

FIG. 6

DB

| USER | APPARATUS | APPARATUS TYPE | COMMUNICATION DESTINATION | DELIVERY DESTINATION | SUBSCRIPTION | CONTAINER | CONTAINER TYPE | AUTHENTICATION INFORMATION |
|---|---|---|---|---|---|---|---|---|
| USER A | APPARATUS A | APPARATUS TYPE A | COMMUNICATION DESTINATION A | DELIVERY DESTINATION A | VALID | CONTAINER A1 | CONTAINER TYPE A | AUTHENTICATION INFORMATION A1 |
| | | | | | | CONTAINER A2 | CONTAINER TYPE A | AUTHENTICATION INFORMATION A2 |
| | | | | | | ... | ... | ... |
| USER B | APPARATUS B | APPARATUS TYPE B | COMMUNICATION DESTINATION B | DELIVERY DESTINATION B | VALID | CONTAINER B1 | CONTAINER TYPE B | AUTHENTICATION INFORMATION B1 |
| | | | | | | CONTAINER B2 | CONTAINER TYPE B | AUTHENTICATION INFORMATION B2 |
| | | | | | | ... | ... | ... |
| ... | ... | ... | ... | ... | ... | ... | ... | ... |

PRINTING APPARATUS AND PRINTING SYSTEM

The present application is based on, and claims priority from JP Application Serial Number 2019-156431, filed Aug. 29, 2019, the disclosure of which is hereby incorporated by reference here in its entirety.

BACKGROUND

1. Technical Field

The present disclosure relates to a printing apparatus and a printing system that perform printing by ejecting a liquid such as ink onto a medium such as paper.

2. Related Art

In the related art, as a type of printing apparatus, an ink jet type printing apparatus is known in which ink is supplied from a liquid accommodation body such as an ink cartridge or an ink tank to an ink ejecting head, and the ink is ejected from an ink ejecting head onto paper to perform printing.

In such a printing apparatus, for example, JP-A-2004-90517 discloses a printing apparatus capable of operating when it is determined to be a dedicated ink cartridge based on information acquired from a mounted ink cartridge and it is determined to be a legitimate user registered as a user in a server apparatus. Meanwhile, in this printing apparatus, the operation stops when it is determined that the mounted ink cartridge is not a dedicated ink cartridge.

However, in such a printing apparatus, for example, an operation is changed depending on whether or not a liquid accommodation body such as a mounted ink cartridge is a dedicated liquid accommodation body, but the when the operation is performed, content of the operation is not changed. That is, it is desirable to operate in a mode suitable for accommodation body information of a liquid accommodation body among a plurality of modes based on information on the liquid accommodation body.

SUMMARY

According to an aspect of the present disclosure, there is provided a printing apparatus configured to communicate with a server apparatus via a network, and including a printing section that performs printing with a printing material accommodated in a printing material accommodation body, a control section that controls printing of the printing section, and an information acquisition section that acquires accommodation body information on the printing material accommodation body, in which the control section performs an operation of a first mode when the accommodation body information acquired by the information acquisition section is first information, and performs an operation of a second mode in a case in which a permission condition is satisfied according to communication with the server apparatus when the accommodation body information acquired by the information acquisition section is second information.

According to another aspect of the present disclosure, there is provided a printing system including a printing apparatus, and a server apparatus configured to communicate with the printing apparatus via a network, in which the printing apparatus includes a printing section that performs printing with a printing material accommodated in a printing material accommodation body, a control section that controls printing of the printing section, and an information acquisition section that acquires accommodation body information on the printing material accommodation body, and in which the control section performs an operation of a first mode when the accommodation body information acquired by the information acquisition section is first information, and performs an operation of a second mode in a case in which a permission condition is satisfied according to communication with the server apparatus when the accommodation body information acquired by the information acquisition section is second information.

BRIEF DESCRIPTION OF THE DRAWINGS

FIG. 6 is a schematic diagram illustrating a user information database stored in a storage section of a server apparatus of the first embodiment.

DESCRIPTION OF EXEMPLARY EMBODIMENTS

First Embodiment

Hereinafter, a printing apparatus and a printing system according to a first embodiment will be described with reference to the drawings.

Figure 1:
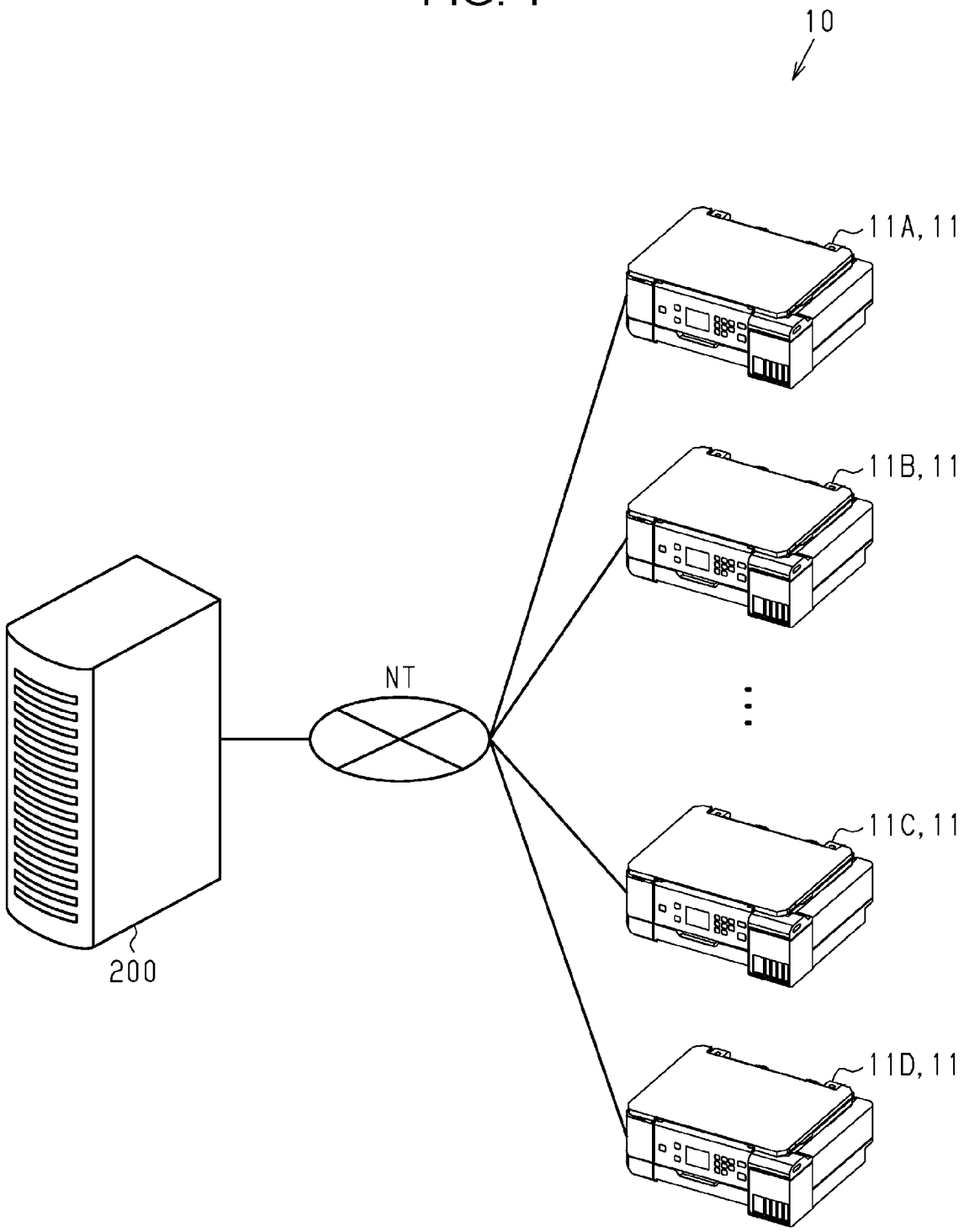
FIG. 1 is a schematic diagram illustrating a printing system according to a first embodiment.

As illustrated in FIG. 1, a printing system 10 includes a plurality of printing apparatuses 11 (printing apparatuses 11A to 11D in the figure) that perform printing on a medium by ejecting ink or the like, which is an example of a liquid as a printing material, onto a medium such as paper, and a server apparatus 200 that provides information to each of the plurality of printing apparatuses 11. The server apparatus 200 is communicably coupled to one or the plurality of printing apparatuses 11 via a network NT. The printing apparatus 11 may be coupled to the network NT via a host apparatus (not illustrated) configured by, for example, a personal computer.

Figure 2:
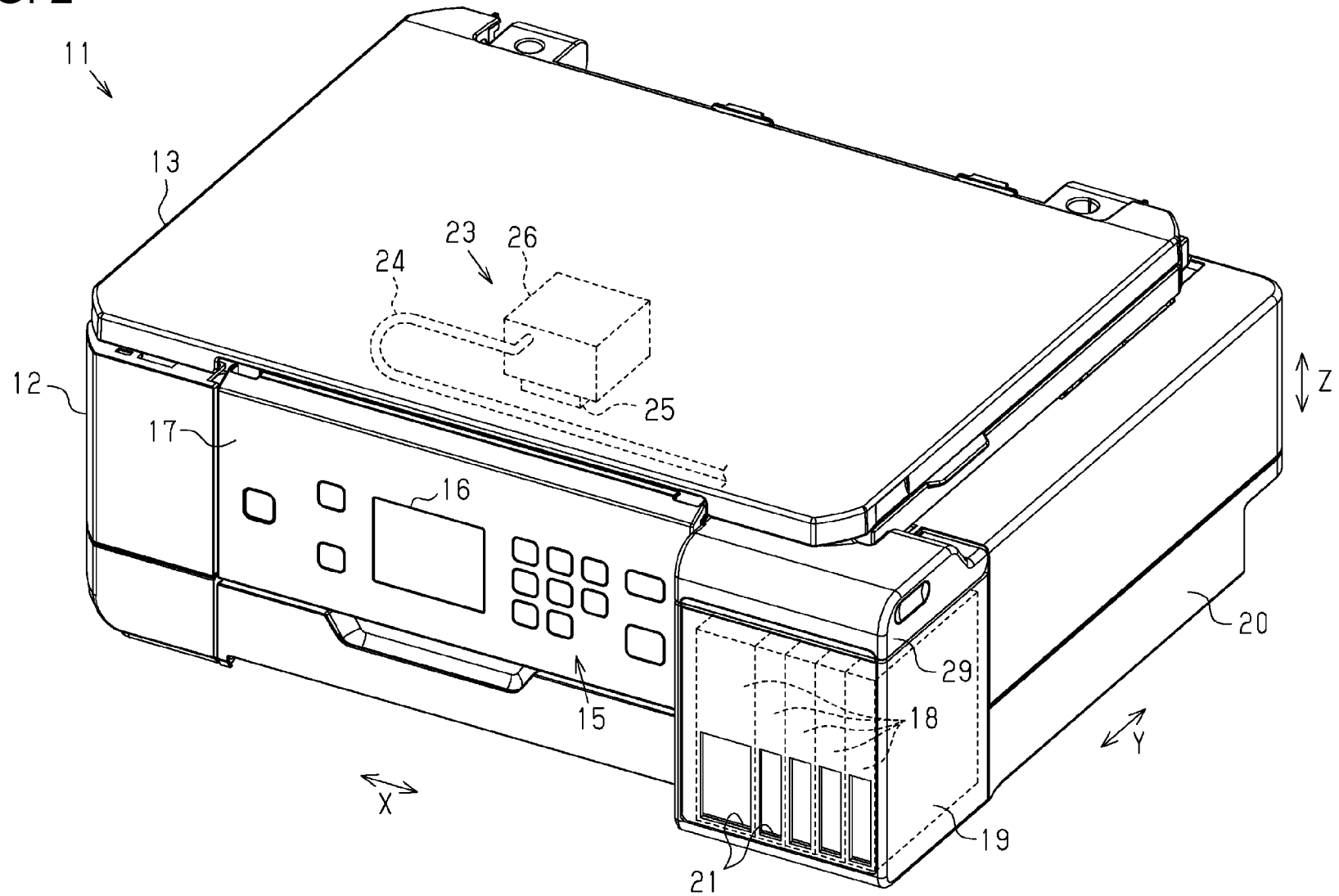
FIG. 2 is a perspective view illustrating a printing apparatus including a printing section according to the first embodiment.

As illustrated in FIG. 2, the printing apparatus 11 includes a printing unit 12 that performs printing on a medium (not illustrated), and an image reading section 13 that is disposed to cover an upper side of the printing unit 12 and reads an image of a document as image data, and has a substantially rectangular parallelepiped shape as a whole.

In the present embodiment, a direction of gravity is referred to as a downward direction, and the opposite direction is referred to as an upward direction. Then, in FIG. 2, assuming that the printing apparatus 11 is placed on a horizontal plane, a direction along the direction of gravity is illustrated as a vertical direction Z, and directions along the horizontal plane are illustrated as a width direction X and a depth direction Y. That is, the width direction X, the depth direction Y, and the vertical direction Z intersect each other (preferably, orthogonally). Further, one end side in the depth direction Y may be referred to as a front side, and the other end side opposite to the one end side may be referred to as a back side.

On the front side of the printing apparatus 11, there are provided with an operation panel 17 having an operation section 15 such as buttons for performing various operations of the printing apparatus 11 and a display section 16 for displaying information or the like of the printing apparatus 11. Furthermore, an accommodation body unit 19 for accommodating at least one (five in the present embodiment) ink accommodation body 18 is provided at an end portion of the printing apparatus 11 adjacent to the operation panel 17. The ink accommodation body 18 is provided in a housing 20 of the printing apparatus 11, and in the housing 20, at least one (five in the present embodiment) wondow portion 21 corresponding to each ink accommodation body 18 is formed. Different types of ink are accommodated in the respective ink accommodation bodies 18 which are liquid accommodation bodies as printing material accommodation bodies. Here, the types of ink include, for example, types of ink colors such as cyan, magenta, yellow, and black, and types of colorants such as pigments and dyes contained in the ink.

Further, the housing 20 is provided with a printing section 23 for performing printing on a medium and a supply section 24 including a tube or the like for supplying the ink accommodated in the ink accommodation body 18 to the printing section 23. The printing section 23 includes an ink ejecting head 25 which is an example of a liquid ejecting head that ejects ink from nozzles 25*a* (see FIG. 4), and a carriage 26 that holds the ink ejecting head 25 and can reciprocate in a width direction X (scanning direction). Then, the printing section 23 performs printing onto a medium by ejecting ink from the moving ink ejecting head 25 toward the medium.

As described above, the operation panel 17 is provided in the housing 20. The ink accommodation body 18, the supply section 24, the ink ejecting head 25 (hereinafter, also referred to as the "ejecting head 25"), the carriage 26, and the like are accommodated in the housing 20. The supply section 24 of the present embodiment is configured by bundling a plurality of tubes individually corresponding to the ink accommodation bodies 18 into one.

Figure 3:
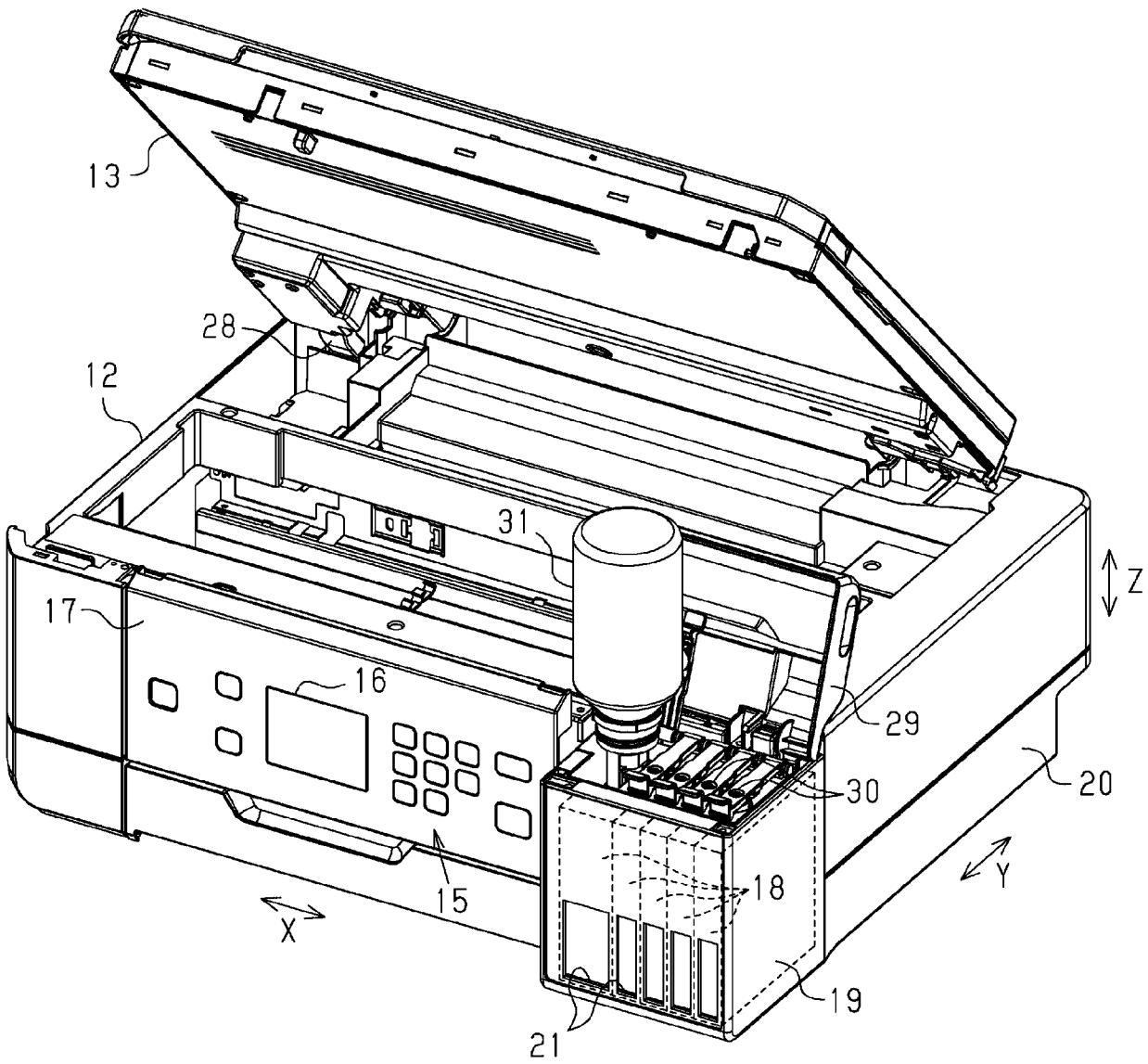
FIG. 3 is a perspective view of the printing apparatus illustrating a state in which ink is replenished to an ink accommodation body.

As illustrated in FIG. 3, the image reading section 13 is attached via a rotation mechanism 28 such as a hinge provided on the back side. The image reading section 13 can be opened and closed with respect to the printing unit 12 and pivots between a closed position illustrated in FIG. 2 and an open position illustrated in FIG. 3. Then, when the image reading section 13 is located at the open position, a cover 29 of the accommodation body unit 19 and a lid 30 attached to the ink accommodation body 18 can be opened and closed. When the ink accommodation body 18 is replenished with the ink, as illustrated in FIG. 3, the image reading section 13, the cover 29, and the lid 30 are located at the open position, and an outlet of an ink bottle 31, which is an example of a liquid container filled with the ink for replenishment, is coupled to a pour of the ink accommodation body 18.

Next, a maintenance section 33 will be described in detail with reference to FIG. 4.

The maintenance section 33 is disposed below the ejecting head 25 when located at a home position illustrated in FIG. 4 where the carriage 26 stands by when the printing is not performed. The maintenance section 33 performs maintenance such as cleaning of the ejecting head 25.

Figure 4:
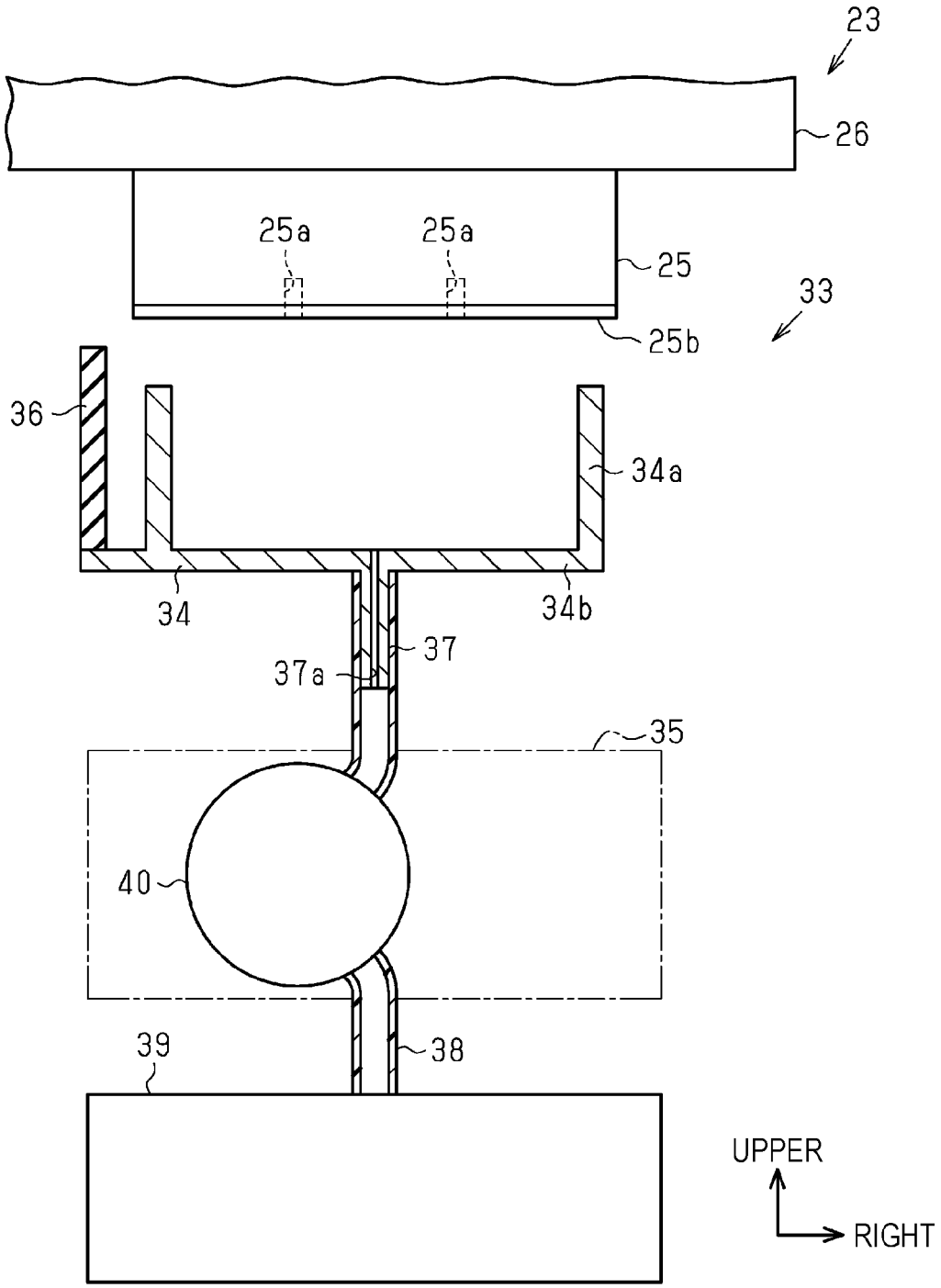
FIG. 4 is a partially exploded schematic diagram illustrating a maintenance section.

As illustrated in FIG. 4, the maintenance section 33 includes a cap 34 having a rectangular box shape with a bottom, a lifting apparatus 35 for lifting and lowering the cap 34, and a wiper 36 that moves up and down together with the cap 34. The wiper 36 is formed of an elastic member such as rubber extending upward to a position higher than a side wall 34*a* of the cap 34. The wiper 36 wipes a nozzle forming surface 25*b* by moving the carriage 26 from a position illustrated in FIG. 4 in the scanning direction in a state where the wiper 36 is raised to a wiping position higher than a retracted position illustrated in FIG. 4.

Further, one end portion of a flexible discharge tube 38 is coupled to a tubular protrusion section 37 protruding downward from a bottom wall 34*b* of the cap 34, while the other end portion of the discharge tube 38 is inserted into a rectangular parallelepiped waste liquid tank 39. An internal space of the cap 34 communicates with the waste liquid tank 39 through a discharge path 37*a* of the protrusion section 37 and the discharge tube 38. A maintenance pump 40 is provided at an intermediate portion of the discharge tube 38. The maintenance pump 40 is, for example, a tube pump.

The cap 34 is moved by the lifting apparatus 35 between the retracted position illustrated in FIG. 4 and a capping position which is raised from the retracted position and at which the cap 34 comes into contact with the nozzle forming surface 25*b*. When the maintenance pump 40 is driven in a state where the cap 34 is at the capping position, a closed space surrounded by the cap 34 and the nozzle forming surface 25*b* has a negative pressure. The ink is forcibly sucked and discharged from a nozzle 25*a* by the negative pressure, so that the ejecting head 25 is cleaned. The waste ink discharged into the cap 34 is discharged to the waste liquid tank 39 through the discharge tube 38. The ink accommodation body 18 serving as an ink supply source is of a pressurized supply type in which the ink is supplied by pressurization by a pressurizing pump. Cleaning may be pressurized cleaning performed to forcibly discharge the ink from the nozzle 25*a* of the ejecting head 25 by the pressurization by the pressurizing pump.

Further, during printing, the carriage 26 periodically moves to the home position, and performs idle ejection (so-called "flushing") in which ink irrelevant to the printing is ejected from the nozzles 25*a* of the ejecting head 25 toward the cap 34. Instead of the cap 34, an ejecting destination of the ink at the time of the idle ejection may be a waste liquid box dedicated to the idle ejection disposed at an end portion of the carriage 26 on a scanning path.

Next, an electrical configuration of the printing system 10 will be described with reference to FIG. 5. Here, the printing system 10 in which one printing apparatus 11 is communicably coupled to the server apparatus 200 via the network NT will be described.

The printing apparatus 11 includes a control section 110. The control section 110 is electrically coupled to a communication section 130, the operation panel 17, a transport motor 27, a carriage motor 32, the printing section 23, the maintenance section 33, and the image reading section 13.

The operation panel 17 includes the operation section 15 and the display section 16. If the display section 16 is a touch panel, the operation section 15 may be configured of an operation function portion of the touch panel.

The control section 110 includes a storage section 120 (memory) formed of a CPU, an application specific integrated circuit (ASIC), a RAM, a nonvolatile memory, and the like. The CPU performs various controls including the control of the printing apparatus 11 by executing control programs stored in the storage section 120. The storage section 120 stores the control programs that perform various controls in the printing apparatus 11 and reference data that is referred to in the control programs. Various pieces of information for controlling the printing apparatus 11 by the control section 110 are stored in the storage section 120. As described above, the control section 110 controls printing performed by the printing section 23. The communication section 130 is communicably coupled to the server apparatus 200 via the network NT.

Further, the control section 110 includes a mode control section 111, a maintenance control section 112, a setting section 113, a counting section 114, an accommodation amount counting section 115, and an information transmission section 116, as a functional section that performs a function by executing a control program.

The mode control section 111 controls a mode in which the printing apparatus 11 operates. The mode in which the printing apparatus 11 operates includes a first mode at a time when ink from a commercially available ink bottle 31 is accommodated in the ink accommodation body 18, and a second mode at a time when ink from the subscription ink bottle 31 is accommodated in the ink accommodation body 18. The subscription is a system in which a fee for a period of using the printing system 10 or the number of printed sheets is generated regardless of the amount of consumed ink.

Different operations are performed in the first mode and the second mode. Specifically, in the second mode, maintenance of the printing section 23 is performed by using the ink accommodated in the ink accommodation body 18 more sufficiently than in the first mode. Further, in the first mode, when it is determined that the amount of ink accommodated in the ink accommodation body is less than or equal to the specified amount, an image indicating that fact is displayed on the display section 16, but in the second mode, such an image is not displayed on the display section 16. In the present example, the specified amount corresponds to a near-end amount and corresponds to the amount that is almost equal to the ink end soon.

The maintenance control section 112 performs the maintenance of the printing section 23. In the present embodiment, at least cleaning for forcibly discharging ink from the nozzles 25*a* of the ejecting head 25 is performed as maintenance of the printing section 23. The maintenance control section 112 controls the maintenance section 33 to clean the printing section 23 by forcibly discharging liquid from the printing section 23. By performing such cleaning, thickened ink, air bubbles, or foreign matters causing ejection failure is eliminated from the nozzles of the ejecting head 25.

Furthermore, idle ejection for ejecting ink irrelevant to printing from the nozzles 25*a* of the ejecting head 25 is also performed as maintenance of the printing section 23. The maintenance control section 112 controls the printing section 23 to cause the printing section 23 to perform the idle ejection. By performing such idle ejection, thickened ink or the like that causes an ejection failure is eliminated from the nozzle 25*a* of the ejecting head 25.

In the present embodiment, the maintenance includes a periodic maintenance that is performed periodically and a user maintenance that is performed according to an instruction of the user such as an operation of the operation section 15. As described above, the maintenance control section 112 performs maintenance of the printing section 23 by controlling the maintenance section 33 periodically or according to an instruction of a user.

Particularly, periodic maintenance is performed when a count value counted by the counting section 114 is a reference value that satisfies the execution condition. In the present embodiment, as will be described in detail below, the count value includes a count value relating to time elapsed from the previous maintenance, and a count value relating to the number of printed sheets which is the number of media printed by the printing section 23 by ejecting ink from the previous maintenance. The maintenance control section 112 performs periodic maintenance when the count value counted from the previous maintenance is the reference value. Specifically, the maintenance control section 112 performs the periodic maintenance when the count value of the time elapsed from the previous maintenance becomes a time reference value which is the reference value for time or the count value of the number of printed sheets counted from the previous maintenance becomes a sheet number reference value which is a reference value for the number of printed sheets. Further, the maintenance control section 112 performs maintenance when receiving an instruction for user maintenance. In the present embodiment, in a case where the user maintenance is performed, when controlled to the second mode, the reference value is changed depending on the count value counted from the previous maintenance to the user maintenance. In the present example, in a case where the user maintenance is performed, when controlled to the second mode, the time reference value is changed depending on the count value of time, and the sheet number reference value is changed depending on the count value of the number of printed sheets. Meanwhile, in a case where the user maintenance is performed, when controlled to the first mode, the time reference value and the sheet number reference value are not changed.

The reason for performing the periodic maintenance every time the time count value reaches the time reference value is that ink in the nozzles 25*a* of the printing section 23 is thickened due to evaporation or the like of water with the elapse of time, or there is a possibility that bubbles that grow to a size causing nozzle failure may exist in the ink in the printing section 23. Further, as the number of printed sheets increases, the foreign matter such as paper dust scattered from the medium may adhere to a vicinity of the nozzle 25*a* of the ejecting head 25, thereby causing the nozzle failure. The reason for performing the periodic maintenance every time the printed-sheet number count value reaches the sheet number reference value is that the foreign matter such as paper dust is removed from the nozzle 25*a* and the nozzle forming surface 25*b* by performing early cleaning before causing the nozzle failure. Further, the larger number of printed sheets means that a printing operation time when the printing section 23 is not capped by the cap 34 is long, and thereby, there is a high possibility that thickening of the ink in and around the nozzle 25*a* is progressing, and thus, before the nozzle failure is caused, cleaning is performed early to remove the thickened ink in the nozzle 25*a*.

Further, in a case where the user maintenance is performed, when controlled to the second mode, the maintenance control section 112 may change the maintenance intensity according to the count value counted from the previous maintenance to the user maintenance In a case where the user maintenance is performed, when controlled to the second mode, the maintenance control section 112 may increase the maintenance intensity indicating intensity of maintenance when the count value counted from the previous maintenance to the user maintenance is the second count value smaller than the first count value rather than when the count value is the first count value. Here, the maintenance indicates the cleaning for forcibly discharging the ink from the nozzle of the ejecting head 25 to the maintenance section 33. In this case, the maintenance intensity indicates the cleaning intensity. The cleaning intensity increases as one or both of a flow rate when the ink is discharged and a cleaning time, which is an operation time of discharging the ink, is increased. In other words, the cleaning intensity increases as one or both of a rotation speed of the maintenance pump 40 driven at the time of the cleaning and a driving time of the maintenance pump 40 increases. Meanwhile, in a case where the user maintenance is performed, when controlled to the first mode, the maintenance intensity does not change.

According to the above control by the maintenance control section 112, in a case where the user maintenance is performed, when controlled to the second mode, the maintenance control section 112 may increase the amount of ejection at the time of the idle ejection according to the count value counted from the previous maintenance to the user maintenance. In this case, the idle ejection may be one or both of the idle ejection accompanying the cleaning and the idle ejection performed during the printing. That is, in a case where the user maintenance is performed, when the count value counted from the previous maintenance to the user maintenance is the second count value smaller than the first count value rather than when the count value is the first count value, the maintenance control section 112 causes the printing section 23 to eject a large amount of ink during the idle ejection. Meanwhile, in a case where the user maintenance is performed, when controlled to the first mode, the ejection amount of the ink ejected by the printing section 23 during the idle ejection does not change.

In a case where the user maintenance is performed, when controlled to the second mode, the maintenance section 33 increases the intensity of maintenance for discharging liquid when the count value counted by the counting section 114 from the previous maintenance to the user maintenance is the second count value smaller than the first count value rather than when the count value is the first count value. Further, in a case where the user maintenance is performed, when controlled to the second mode, the maintenance section 33 ejects a large amount of liquid when the count value counted by the counting section 114 from the previous maintenance to the user maintenance is the second count value smaller than the first count value rather than when the count value is the first count value. Here, the idle ejection includes a first idle ejection performed to adjust a meniscus of the ink in the nozzle 25*a* immediately after the cleaning ends, and a second idle ejection performed periodically during the printing. In the present embodiment, in both the first idle ejection and the second idle ejection, the liquid is ejected more in the second count value, which is smaller than the first count value, than in the first count value. For example, only in the first idle ejection of the first idle ejection and the second idle ejection, the liquid may be ejected more in the second count value than in the first count value, and only in the second idle ejection, the liquid may be ejected more in the second count value than in the first count value.

In a case where the user maintenance is performed, when controlled to the second mode, the setting section 113 stores the reference value in the storage section 120 based on the count value counted from the previous maintenance to the user maintenance by the counting section 114, thereby setting the reference value with which the execution condition of the periodic maintenance is satisfied. Particularly, as will be described in detail below, in a case where the user maintenance is performed, when controlled to the second mode, the setting section 113 sets the count value as a reference value when the count value counted from the previous maintenance to the user maintenance by the counting section 114 is greater than or equal to a lower limit value. Meanwhile, when the count value is less than the lower limit value, the setting section 113 sets the lower limit value as the reference value.

The counting section 114 counts a count value from the previous maintenance. In the present example, the counting section 114 counts the count value to determine whether or not to reach an interval from the previous maintenance to the next maintenance. The interval includes a time, the number of printed sheets, the number of passes, and the like. The count value relating to the interval counted by the counting section 114 includes a count value relating to time, a count value relating to the number of printed sheets, a count value relating to the number of passes, and the like. Particularly, the counting section 114 counts the count value relating to time elapsed from the previous maintenance by updating a time counter assigned to the storage section 120. Further, the counting section 114 counts the count value relating to the number of printed sheets from the previous maintenance by updating a printed-sheet number counter assigned to the storage section 120. When the printing apparatus 11 is a serial printer that performs printing by ejecting ink toward a medium while moving the printing section 23 in a scanning direction, scanning of the printing section 23 in which the carriage 26 is moved once in the scanning direction while ejecting ink from the nozzles 25*a* of the ejecting head 25, and transport of the medium to the next printing position are alternately performed. The counting section 114 counts the count value relating to the number of passes from the previous maintenance by updating a pass number counter assigned to the storage section 120. Here, one scanning in which the printing section 23 moves while ejecting liquid is called a pass, and the pass number counter counts the number of passes from the previous maintenance as a count value. The counting section 114 may be configured by a counter provided with an electronic circuit such as an ASIC.

The accommodation amount counting section 115 counts a consumption amount of ink ejected by the printing section 23 and a consumption amount of ink filled in the delivered ink bottle 31. The accommodation amount counting section 115 includes various counters assigned to the storage section 120. The accommodation amount counting section 115 includes an ink counter that counts an ink consumption amount from timing when authentication information on the new ink bottle 31 is authenticated by the server apparatus 200, and an ink bottle counter that counts the consumption amount of ink that is filled in the ink bottle 31 and start to be used from the timing when the new ink bottle 31 is authenticated. The ink bottle counter of the present embodiment counts the remaining amount of the ink bottle 31 corresponding to a value obtained by subtracting the ink consumption amount from the filling amount filled in the ink bottle 31, as the consumption amount of the ink bottle 31. Here, the remaining amount of the ink bottle 31 counted by the ink bottle counter is a total value of the remaining amount of ink in the ink bottle 31 and the remaining amount of ink in the ink accommodation body 18 which is a pouring destination of the ink from the ink bottle 31. That is, the ink bottle counter counts the total remaining ink amount of the ink bottle 31 and the ink accommodation body 18.

The information transmission section 116 transmits various types of information to the server apparatus 200. Particularly, the information transmission section 116 transmits authentication-related information including authentication information to the server apparatus 200 as a result of reading an authentication image involved in the ink bottle 31 for subscription. The authentication information is an example of accommodation body information capable of identifying the ink bottle 31 for pouring ink into the ink accommodation body 18, in other words, is an example of accommodation body information on the ink accommodation body 18.

The transport motor 27 is a drive source that transports the medium according to a control signal from the control section 110. The carriage motor 32 is a drive source that drives the carriage 26 according to a control signal from the control section 110. When the printing apparatus 11 is a line printer, an electrical configuration thereof is the same as that of FIG. 5 excluding the carriage motor 32. The printing section 23 ejects ink onto a medium according to a control signal from the control section 110. The image reading section 13 reads an image according to a control signal from the control section 110, and outputs read image data to the control section 110.

The server apparatus 200 includes a control section 210, a storage section 220, and a communication section 230. The control section 210 includes a CPU. The CPU performs various controls relating to the server apparatus 200 by executing control programs. The storage section 220 stores control programs that perform various controls in the server apparatus 200 and reference data that is referred to in the control programs. The communication section 230 is communicably coupled to another apparatus such as the printing apparatus 11 via the network NT.

Further, the control section 210 is a functional section that performs a function by executing a control program and includes a permission condition determination section 211 and a determination result information transmission section 212.

When receiving the authentication-related information from the printing apparatus 11, the permission condition determination section 211 collates authentication information included in the authentication-related information with authentication information stored in a user information database which will be described below, and determines whether or not a permission condition is satisfied based on a result of the collation. As described above, the permission condition determination section 211 determines whether or not the permission condition is satisfied based on the authentication information from the printing apparatus 11.

The determination result information transmission section 212 transmits determination result information indicating a result determined by the permission condition determination section 211 to the printing apparatus 11.

In such a printing system 10, information relating to a plurality of printing apparatuses 11 configuring the printing system 10 is managed as a user information database in the server apparatus 200. Then, an authentication control according to an authentication request from the printing apparatus 11 is performed. Meanwhile, the printing apparatus 11 performs a counting control of the consumption amount of the ink filled in the ink bottle 31 and a printing control based on the authentication result.

In the present embodiment, the storage section 220 of the server apparatus 200 stores a user information database. The user information database is an information group for managing information on the printing apparatus 11.

As illustrated in FIG. 6, in a user information database DB, one or a plurality of pieces of apparatus identification information is associated with one piece of user identification information. The user identification information is identification information unique to the user, which can identify the user. The apparatus identification information is identification information unique to the printing apparatus 11, which can identify the printing apparatus 11.

In a user information database DB, one piece of apparatus identification information is associated with apparatus type information, apparatus communication information, delivery destination information, and subscription information. The apparatus type information is information capable of identifying the type (model) of the printing apparatus 11. The apparatus communication information is information for communicating with the printing apparatus 11. The delivery destination information is information indicating a place where the printing apparatus 11 is installed, and is information for delivering the ink bottle 31. The subscription information is information indicating whether the subscription is valid or invalid.

In the user information database DB, one piece of apparatus identification information is associated with one or a plurality of container identification information. The container identification information is identification information unique to an ink bottle which is an example of a liquid container and can identify the ink bottle 31 that can be used in the printing apparatus 11.

In the user information database DB, one piece of the container identification information is associated with container type information and authentication information. The container type information is information indicating the type of the ink bottle 31, and can identify the amount of ink filled in the ink bottle 31. The authentication information is information used for authentication between the server apparatus 200 and the printing apparatus 11 after the ink bottle 31 is delivered.

In the server apparatus 200, user registration is performed before using the printing apparatus 11. In the user registration, user identification information, apparatus identification information, apparatus type information, apparatus communication information, delivery destination information, and subscription information are associated in the user information database DB based on information transmitted from the printing apparatus 11.

Then, in a case where there is a delivery request of the ink bottle 31 from the printing apparatus 11, when the subscription information corresponding to the apparatus identification information of the printing apparatus 11 requested delivery is valid, the server apparatus 200 generates container information; container type information and authentication information to register in the user information database DB. Accordingly, information on the delivered ink bottle 31 is registered in the user information database DB according to a delivery request of the ink bottle 31.

Here, various processes performed by the printing apparatus 11 and the server apparatus 200 according to various control programs will be described. First, an authentication process executed by the printing apparatus 11 will be described. This authentication process is executed by the control section 110 of the printing apparatus 11 when an authentication instruction is generated according to an operation of the operation section 15.

Figure 7:
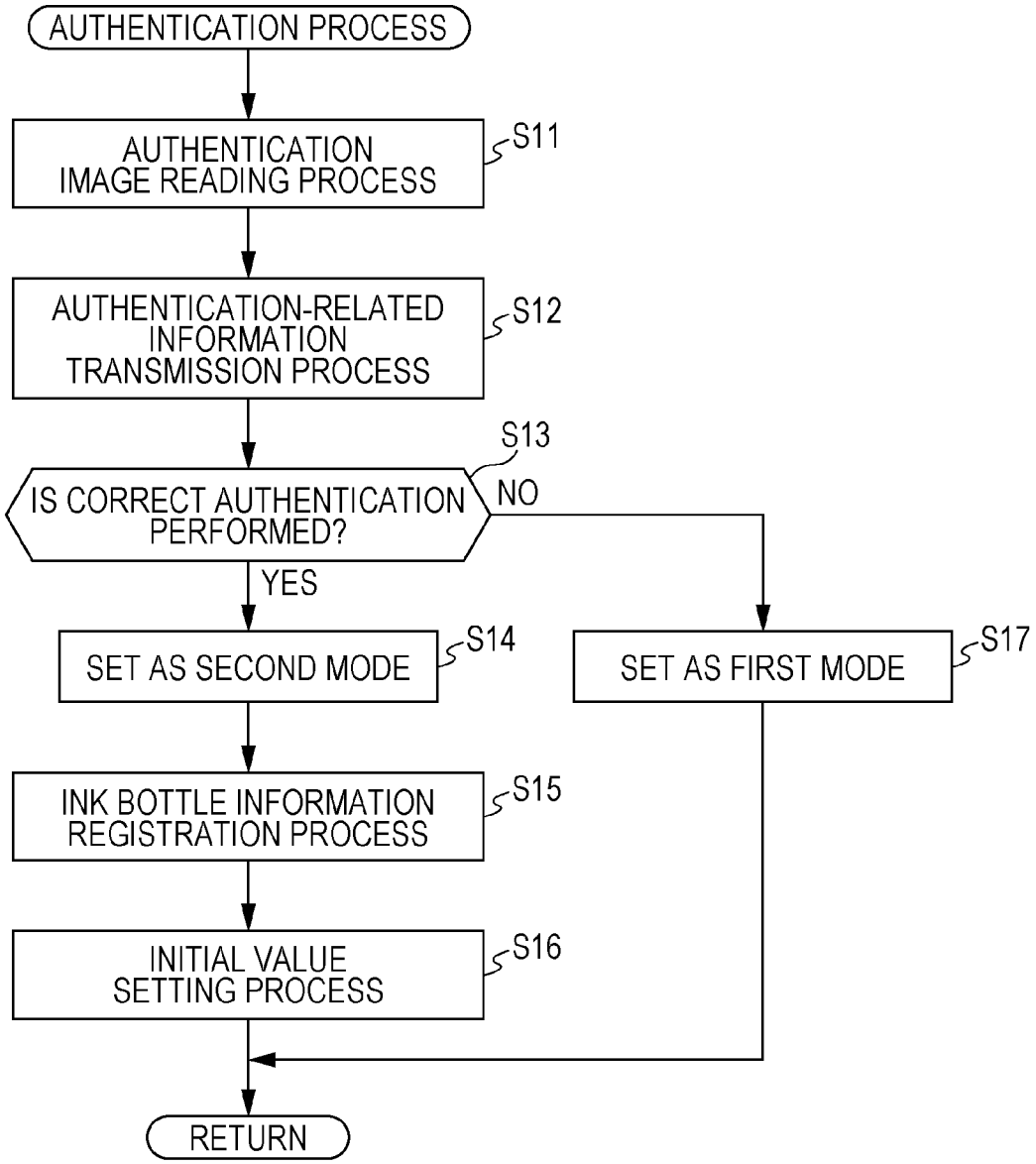
FIG. 7 is a flowchart illustrating an authentication process executed by a control section of the printing apparatus.

As illustrated in FIG. 7, in step S11, the control section 110 executes an authentication image reading process of causing the image reading section 13 to read an authentication image as authentication information involved in the delivered ink bottle 31. In the present example, the ink bottle 31 for subscription is delivered to a delivery destination of the printing apparatus 11 in which the subscription information is valid. The ink bottle 31 for the subscription involves an authentication image as authentication information unlike a commercially available ink bottle 31. In this process, the control section 110 outputs a reading instruction for causing the image reading section 13 to read the authentication image and causes the storage section 120 to store the image data read by the image reading section 13 as authentication information. As described above, the image reading section 13 acquires the authentication information involved in the ink bottle 31 as information relating to the ink bottle 31. The image reading section 13 corresponds to an example of an information acquisition section.

Then, in step S12, the control section 110 executes an authentication-related information transmission process of generating an authentication request by transmitting the authentication-related information to the server apparatus 200 via the communication section 130 and the network NT. The authentication-related information includes the authentication information read by the image reading section 13 and the apparatus identification information unique to the printing apparatus 11. As described above, when the acquired authentication information is the authentication information for the subscription, the control section 110 transmits the authentication information for determining whether or not the permission condition is satisfied to the server apparatus 200. The authentication information for the subscription corresponds to an example of second information, and the authentication information other than the information for the subscription corresponds to an example of first information, and the authentication-related information corresponds to an example of determination information.

Meanwhile, when the server apparatus 200 receives the authentication-related information via the network NT and the communication section 230, the control section 210 refers to one or a plurality of pieces of authentication information corresponding to the apparatus identification information included in the received authentication-related information in the authentication information registered in the user information database DB. Then, the control section 210 collates the referred authentication information with the authentication information included in the received authentication-related information. As described above, the control section 210 determines whether or not the permission condition is satisfied based on the authentication-related information from the printing apparatus 11. Such a process is executed by the permission condition determination section 211 of the control section 210.

When it is determined that there is authentication information that matches the authentication information included in the received authentication-related information as a result of the collation, the control section 210 transmits the authentication result information indicating that a correct authentication is performed to the printing apparatus 11 outputting the authentication-related information, via the communication section 230 and the network NT. Meanwhile, when it is determined that there is no authentication information that matches the authentication information included in the received authentication-related information as a result of the collation, the control section 210 transmits the authentication result information indicating that the correct authentication is not performed to the printing apparatus 11 outputting the authentication-related information via the communication section 230 and the network NT. As described above, the control section 210 transmits the authentication result information indicating the result of the determination as to whether or not the permission condition is satisfied, to the printing apparatus 11. Such a process is performed by the determination result information transmission section 212 of the control section 210. This authentication result information corresponds to an example of the determination result information.

In step S13, the control section 110 in the printing apparatus 11 determines whether or not a correct authentication is performed based on the authentication result information transmitted from the server apparatus 200. When receiving the authentication result information indicating that the correct authentication is not performed and determining that the correct authentication is not performed, the control section 110 sets the first mode by storing information indicating the first mode in a mode flag assigned to the storage section 120 (step S17), and the authentication process ends. This mode flag indicates a type of the mode to be controlled.

When receiving the authentication result information indicating that the correct authentication is performed and determining that the correct authentication is performed, the control section 110 sets the second mode by storing information indicating the second mode in the mode flag assigned to the storage section 120 in step S14.

Before using the printing apparatus 11, information indicating the first mode is stored in the mode flag. Then, as a result of the collation using the authentication image involved in the ink bottle 31 for subscription, the authentication result information indicating that the correct authentication is performed is received according to communication with the server apparatus 200, and when the permission condition is satisfied, information indicating the second mode is stored in the mode flag. As a result of the collation using the authentication image involved in the ink bottle 31 for subscription, the authentication result information indicating that the correct authentication is not performed is received according to the communication with the server apparatus 200, and when the permission condition is not satisfied, information indicating the first mode is stored in the mode flag. Further, as will be described in detail below, when it is estimated that all the ink bottles 31 for subscription are consumed, the information indicating the first mode is stored in the mode flag, and the first mode is controlled instead of the second mode.

As described above, when the acquired authentication information is the authentication information for the subscription, the control section 110 receives the determination result information indicating that the permission condition is satisfied from the server apparatus 200, and sets the mode to the second mode and performs an operation in the second mode when the permission condition based on the authentication information is satisfied according to the communication with the server apparatus 200. Further, in other words, the permission condition is satisfied when the determination result information indicating that the permission condition based on the authentication information is satisfied is received from the server apparatus 200. Meanwhile, when the authentication information is not the authentication information for the subscription, the control section 110 receives the determination result information indicating that the permission condition is not satisfied from the server apparatus 200, and sets the mode to the first mode and performs an operation in the first mode without satisfying the permission condition based on the authentication information according to the communication with the server apparatus 200.

Next, in step S15, the control section 110 executes an ink bottle information registration process. In this process, the control section 110 registers the ink bottle information by cumulatively storing the ink bottle information in which a type of the ink bottle 31 correctly authenticated and the authentication information are associated with each other, in the storage section 120.

Then, in step S16, the control section 110 executes an initial value setting process, and ends the authentication process. In this process, the control section 110 sets "0" as an initial value in the ink counter assigned to the storage section 120. This ink counter indicates ink consumption amount for each color, which is indicated by the sum of the ink consumption amount consumed for printing and the ink consumption amount consumed for maintenance for each color ink based on image data to be printed. As described above, the control section 110 sets an initial value in the ink counter when authentication information on the delivered new ink bottle 31 is authenticated.

Further, the control section 110 reads a value indicating a filling amount of the ink bottle 31 corresponding to a type of the delivered ink bottle 31 from the storage section 120, and adds the value to an ink bottle counter assigned to the storage section 120. This ink bottle counter indicates a remaining amount that is estimated to be accommodated in the ink bottle 31 and the ink accommodation body 18 without being yet ejected (not consumed) by the printing section 23 from among the ink of each color filled in the delivered ink bottle 31. As described above, when the authentication information relating to the delivered new ink bottle 31 is authenticated, the control section 110 adds a value corresponding to the amount of ink filled in the ink bottle 31 to the ink bottle counter, and thereby, the initial value is set to a count value relating to a consumption amount of the ink filled in the ink bottle 31.

When the ink bottle 31 is authenticated, the control section 110 may set a correction value obtained by adding the remaining ink amount of the ink accommodation body 18 acquired based on an input value from the operation section 15 to the filling amount of the ink bottle 31 as the initial value of the ink bottle counter.

Next, a printing control process executed by the printing apparatus 11 will be described. The printing control process is executed by the control section 110 of the printing apparatus 11 when a printing instruction is issued according to an operation of the operation section 15.

When a user issues a printing instruction, the control section 110 of the printing apparatus 11 controls the transport motor 27, the carriage motor 32, and the printing section 23 based on the image data included in the printing instruction to execute a printing process of performing printing by ejecting ink onto a medium.

Further, the control section 110 adds a value indicating a consumption amount of ink consumed for each color ink to the ink counter assigned to the storage section 120 based on the printed image data as a result of execution of the printing process. The control section 110 adds a value indicating a consumption amount of ink discharged from the printing section 23 for maintenance of the nozzles 25*a* of the printing section 23 to the ink counter. Accordingly, the control section 110 can recognize a consumption amount of the consumed ink by counting a consumption amount of consumed ink and adding a result of the counting to the ink counter assigned to the storage section 120. When controlled to the second mode, the control section 110 subtracts a value indicating the consumption amount of the consumed ink for each color ink from the ink bottle counter assigned to the storage section 120 based on the printed image data as a result of the execution of the printing process. The control section 110 subtracts a value indicating an ink consumption amount discharged from the printing section 23 for maintenance of the nozzles of the printing section 23 from the ink bottle counter, and calculates a remaining amount (consumption amount) of ink filled in the delivered ink bottle 31. Accordingly, the control section 110 can recognize the remaining amount of the ink filled in the delivered ink bottle 31 by counting the consumption amount of the consumed ink and subtracting the counted result from the ink bottle counter assigned to the storage section 120. Such a process is executed by the accommodation amount counting section 115 of the control section 110. When controlled to the second mode, the control section 110 transmits a delivery request to the server apparatus 200 based on a value of the ink bottle counter before consumption of the ink filled in the ink bottle 31 is completed.

Then, the control section 110 adds a value indicating the number of printed sheets of the printed medium to the printed-sheet number counters a result of the execution of the printing process, and ends the printing control process. The printed-sheet number counter is assigned to the storage section 120 and counts the number of printed sheets of the medium printed after the previous maintenance. Further, when printing is performed on media of a plurality of sizes, the printed-sheet number counter may be configured to count a value converted into the number of printed sheets based on a specified size (for example, A4 size). As such, the control section 110 counts the number of printed media on which ink is ejected by the printing section 23 from the previous maintenance. Such a process is executed by the counting section 114 of the control section 110.

Further, in the time counting process different from the printing control process, in the printing apparatus 11, the control section 110 compares the time at which the previous maintenance stored in the storage section 120 is performed with a current time at every predetermined interval. Then, the time elapsed from the previous maintenance is set in a time counter, and the time counting process is ended. The time counter is assigned to the storage section 120, and counts the time elapsed since the previous maintenance is performed. The previous maintenance may be the periodic maintenance or the user maintenance. As described above, the control section 110 counts the time elapsed from the previous maintenance. Such a process is executed by the counting section 114 of the control section 110. When the printing apparatus 11 is used for the first time, the control section 110 stores a first use time in the storage section 120, compares the first use time with the current time, and sets the time elapsed from the first use time in the time counter.

Next, a maintenance control process executed by the printing apparatus 11 will be described. The maintenance control process is executed by the control section 110 of the printing apparatus 11 at every predetermined interval.

Figure 8:
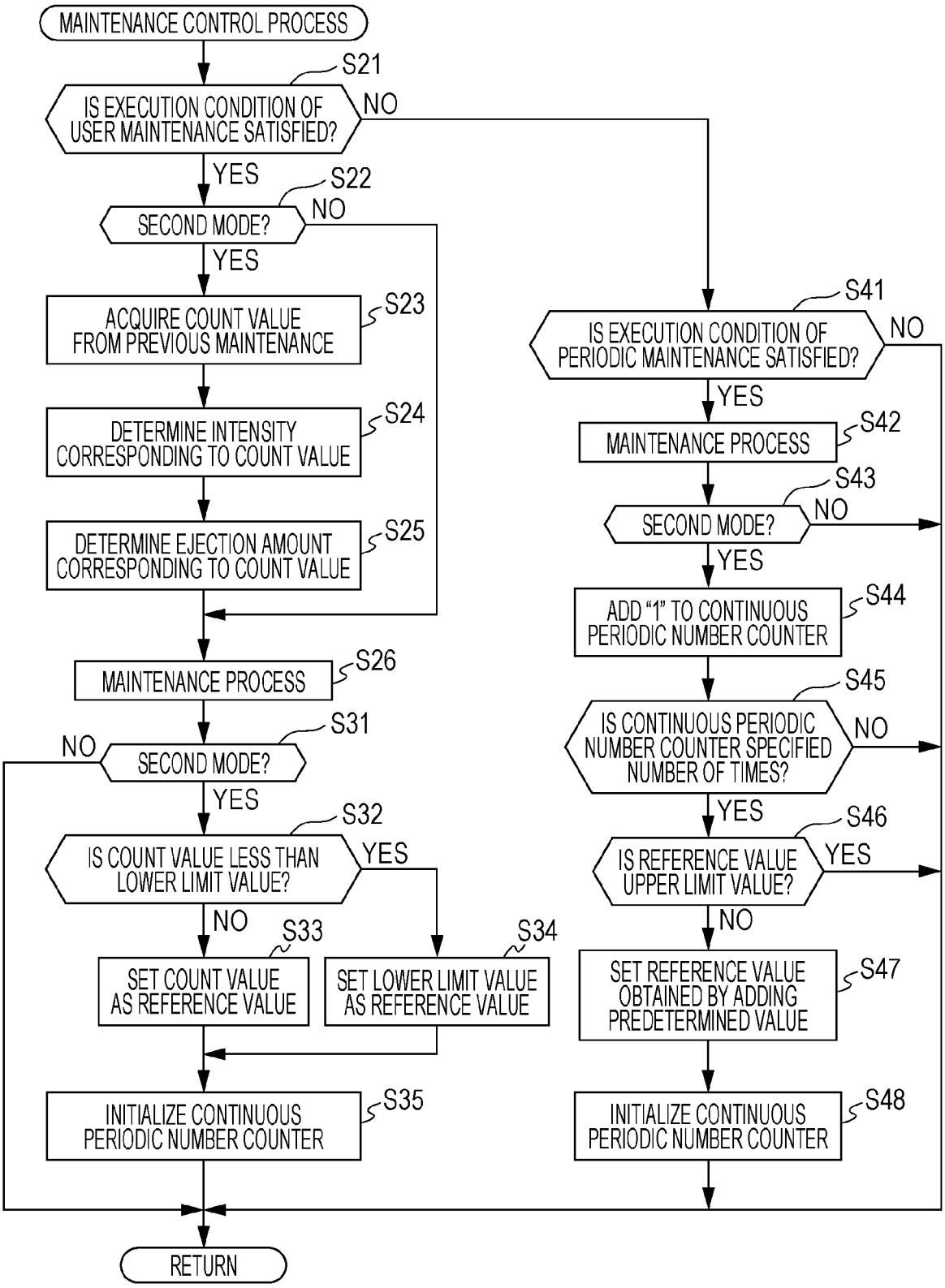
FIG. 8 is a flowchart illustrating a maintenance control process executed by the control section of the printing apparatus.

As illustrated in FIG. 8, in step S21 of the maintenance control process, the control section 110 of the printing apparatus 11 determines whether or not an execution condition of the user maintenance is satisfied. In this process, the control section 110 determines that the execution condition of the user maintenance is satisfied when a maintenance instruction is issued by the user according to an operation of the operation section 15. When it is determined that the execution condition of the user maintenance is not satisfied, the control section 110 proceeds to step S41. Meanwhile, when it is determined that the execution condition of the user maintenance is satisfied, the control section 110 proceeds to step S22.

In step S22, the control section 110 reads the information stored in the mode flag and determines whether or not in the second mode. When it is determined not to be in the second mode, the control section 110 proceeds to step S26 without executing steps S23 to S25. Meanwhile, when it is determined to be in the second mode, the control section 110 proceeds to step S23.

In step S23, the control section 110 reads a value of the printed-sheet number counter and a value of the time counter assigned to the storage section 120, and acquires a count value from the previous maintenance.

Next, in step S24, the control section 110 determines a maintenance intensity corresponding to the count value. Specifically, the control section 110 determines a cleaning intensity corresponding to the count value. A plurality of steps of the cleaning intensity are prepared. A range from a lower limit value to an upper limit value of the count value is divided into a plurality of steps, and the control section 110 selects the cleaning intensity according to a step to which the read count value belongs. The control section 110 selects the cleaning with larger intensity in a step where the count value is smaller. In the present example, the range from the lower limit value to the upper limit value of the time count value, which is the count value of the time, is divided into a plurality of steps. The control section 110 selects the cleaning intensity, as a candidate, according to the step to which the read time count value belongs. Further, the range from the lower limit value to the upper limit value of the sheet number count value, which is the count value of the number of printed sheets, is divided into a plurality of steps. The control section 110 selects the cleaning intensity, as a candidate, according to the step to which the read sheet number count value belongs. The time count value which is a value of the time counter at the time of instructing the user maintenance, and the sheet number count value which is a value of the printed-sheet number counter, are obtained. The control section 110 acquires cleaning intensity corresponding to the time count value and cleaning intensity corresponding to the sheet number count value as candidates, and determines the larger one of the two cleaning intensities acquired as candidates. The control section 110 may select the smaller one of the two cleaning intensities acquired as candidates. Further, when the user maintenance is instructed, one of the time count value and the sheet number count value may be employed, and the cleaning intensity corresponding to the one may be determined. For example, the time count value may be employed to determine the cleaning intensity corresponding to the time count value, or the number of printed sheets may be employed to determine the cleaning intensity corresponding to the sheet number count value. In step S24, the control section 110 is executed in the second mode, but determines maintenance intensity corresponding to the count value such that the cleaning intensity is greater than the cleaning intensity in the first mode.

In the next step S25, the control section 110 executes an ejection amount increasing process of increasing the ejection amount of ink ejected from the printing section 23 during maintenance, and proceeds to step S26.

Next, in step S26, the control section 110 performs a maintenance process. In this process, the control section 110 performs at least cleaning for discharging ink from the nozzles 25*a* of the printing section 23. Further, the control section 110 initializes the printed-sheet number counter and the time counter assuming that the maintenance is performed. As described above, the control section 110 performs cleaning for discharging at least the ink from the printing section 23 as the user maintenance. In other words, the control section 110 performs the user maintenance according to an instruction of a user.

Particularly, the control section 110 performs the cleaning in a previously determined cleaning intensity corresponding to the count value in the user maintenance. That is, when the user maintenance is performed, the control section 110 performs the cleaning in an intensity corresponding to the count value counted from the previous maintenance to the user maintenance.

For example, in the user maintenance, when in the second mode, the control section 110 performs cleaning at an intensity corresponding to the value of the time counter. In this case, the control section 110 performs cleaning at the first intensity when the time count value which is a value of the time counter at the time of instructing the user maintenance is the first time count value, and performs the cleaning at the second intensity greater than the first intensity at the time of the second time count value less than the first time count value. In other words, as the maintenance interval is shortened, the cleaning intensity increases stepwise. Further, in the user maintenance, when the cleaning is performed at the intensity corresponding to the value of the printed-sheet number counter, the control section 110 performs cleaning at the first intensity when the sheet number count value, which is the value of the printed-sheet number counter at the time of being instructed, is a first sheet number count value. Meanwhile, the control section 110 performs cleaning at the second intensity greater than the first intensity at the time of a second sheet number count value less than the first sheet number count value. That is, as the number of printed sheets which are printed from the previous maintenance to the user maintenance decreases, the cleaning intensity increases stepwise. In the user maintenance, when in the first mode, the control section 110 performs cleaning at a predetermined constant intensity with a smaller cleaning intensity than in the second mode.

After the cleaning, the control section 110 starts the printing when receiving a printing instruction. The control section 110 periodically moves the carriage 26 to a home position during printing, and performs idle ejection of ejecting ink from the ejecting head 25 toward the cap 34 with an ejection amount which is determined in step S25 and corresponds to the count value. The control section 110 performs the idle ejection with a first ejection amount when the count value at the time of instructing the user maintenance is the first count value, and performs the idle ejection with a second ejection amount more than the first ejection amount when the count value is the second count value smaller than the first count value. Even at the time of printing after the periodic maintenance, for example, the idle ejection may be performed with the ejection amount determined in step S25 during the previous user maintenance. That is, it can be said that the ejection amount corresponding to the count value determined in step S25 is an ejection amount corresponding to the reference value. That is, during printing after the periodic maintenance, the control section 110 performs the idle ejection with the first ejection amount when the reference value is a first reference value, and performs the idle ejection with the second ejection amount more than the first ejection amount when the reference value is a second reference value less than the first reference value. For example, as the maintenance interval is shortened, the ejection amount at the time of the idle ejection increases stepwise. Further, in step S25, the control section 110 determines an ejection amount corresponding to the count value such that the ejection amount of the idle ejection is more than the ejection amount at the time of being in the first mode although being executed at the time of the second mode. Such a process is executed by the maintenance control section 112 of the control section 110.

In step S31, the control section 110 reads the information stored in the mode flag and determines whether or not in the second mode. When it is determined not to be in the second mode, the control section 110 ends the maintenance control process without executing steps S32 to S35. Meanwhile, when it is determined to be in the second mode, the control section 110 proceeds to step S32.

In step S32, the control section 110 determines whether or not the count value is less than the lower limit value. Specifically, when the value of the printed-sheet number counter is less than the sheet number lower limit value or when the value of the time counter is less than the time lower limit value, the control section 110 determines that the count value is less than the lower limit value. Meanwhile, when the value of the printed-sheet number counter is greater than or equal to the sheet number lower limit value and the value of the time counter is greater than or equal to the time lower limit value, the control section 210 determines that the count value is not less than the lower limit value. For the sheet number lower limit value and the time lower limit value, values corresponding to the apparatus type information are referred to.

When it is determined that the count value is not less than the lower limit value, the control section 110 determines the count value as the reference value, sets the count value as the reference value (step S33), and proceeds to step S35. Meanwhile, when it is determined that the count value is less than the lower limit value, the control section 210 determines the lower limit value as the reference value, sets the lower limit value as the reference value (step S34), and proceeds to step S35. As such, the control section 110 performs a control in the second mode, and determines a count value counted from the previous maintenance to the user maintenance as the reference value when the count value counted from the previous maintenance to the user maintenance is greater than or equal to the lower limit value. Meanwhile, the control section 110 performs a control in the second mode, and determines the lower limit value as the reference value when the count value counted from the previous maintenance to the user maintenance is less than the lower limit value. Then, the control section 110 sets the determined reference value. Accordingly, in a case where the user maintenance is performed in the second mode, when the count value counted from the previous maintenance to the user maintenance is greater than or equal to the lower limit value, the control section 110 sets the count value counted from the previous maintenance to the user maintenance as the reference value. Meanwhile, when the count value counted from the previous maintenance to the user maintenance is less than the lower limit value, the control section 110 sets the lower limit value as the reference value. Such a process is performed by the setting section 113 of the control section 110. When one of the value of the printed-sheet number counter and the value of the time counter is less than the lower limit value and the other is greater than or equal to the lower limit value, the control section 110 determines the lower limit value as the reference value corresponding to one count value less than the lower limit value, and determines the count value as the reference value corresponding to the other count value greater than or equal to the lower limit value.

In step S35, the control section 110 initializes a continuous periodic number counter assigned to the storage section 120 and ends the maintenance control process. The continuous periodic number counter is assigned to the storage section 120 and counts the number of times that the periodic maintenance is continuously performed. As described above, when the user maintenance is performed, the continuous periodic number counter is initialized.

In step S41, the control section 110 determines whether or not the execution condition of the periodic maintenance is satisfied. In this process, when the count value of the counting section 114 is greater than or equal to the reference value, the control section 110 determines that the execution condition of the periodic maintenance is satisfied. The value of the printed-sheet number counter is read, and when the value of the printed-sheet number counter is a sheet number reference value or more, it is determined that the execution condition of the periodic maintenance is satisfied. Further, the control section 110 reads the value of the time counter, and determines that the execution condition of the periodic maintenance is satisfied when the value of the time counter is a time reference value or more. When the value of the printed-sheet number counter is greater than or equal to the sheet number reference value or when the value of the time counter is greater than or equal to the time reference value, whether or not the execution condition of the periodic maintenance is satisfied is determined. When it is determined that the execution condition of the periodic maintenance is not satisfied, the control section 110 ends the maintenance control process. Meanwhile, when it is determined that the execution condition of the periodic maintenance is satisfied, the control section 110 proceeds to step S42.

Next, in step S42, the control section 110 performs a maintenance process and initializes the printed-sheet number counter and the time counter, as in step S26. Further, in the periodic maintenance, the control section 110 performs cleaning with a predetermined constant intensity in the same manner as in the first mode and in the second mode. Further, in the periodic maintenance, the control section 110 performs cleaning with a cleaning intensity less than the cleaning intensity of the user maintenance but may perform the cleaning with the same cleaning intensity as the cleaning intensity of the user maintenance. As described above, the control section 110 performs cleaning for discharging the ink from at least the printing section 23 as the periodic maintenance. In other words, the control section 110 performs periodic maintenance when the count value becomes the reference value. Similarly to the case where the cleaning is performed at the intensity corresponding to the count value in the user maintenance, the cleaning may be performed at the intensity corresponding to the reference value in the periodic maintenance.

Then, in step S43, the control section 110 reads the information stored in the mode flag and determines whether or not in the second mode. When it is determined not to be in the second mode, the control section 110 ends the maintenance control process without executing processes of steps S44 to S48. Meanwhile, when it is determined to be in the second mode, the control section 110 proceeds to step S44.

In step S44, the control section 110 adds "1" to the continuous periodic number counter. Then, in step S45, the control section 110 determines whether or not the value of the continuous periodic number counter becomes a value corresponding to a specified number of times. In the present embodiment, "5" is adopted as the specified number of times, but the specified number of times may be "1" to "4", "6" or more. When it is determined that the value of the continuous periodic number counter is not a value corresponding to the specified number of times, the control section 110 ends the maintenance control process. Meanwhile, when it is determined that the value of the continuous periodic number counter becomes the value corresponding to the specified number of times, the control section 110 proceeds to step S46.

In step S46, the control section 110 determines whether or not the reference value is the upper limit value. Specifically, the control section 210 determines that the count value is the upper limit value when the value of the printed-sheet number counter is the sheet number upper limit value or when the value of the time counter is the time upper limit value. Meanwhile, when the value of the printed-sheet number counter is less than the sheet number upper limit value and the value of the time counter is less than the time upper limit value, the control section 210 determines that the count value is not the upper limit value. For the sheet number upper limit value and the time upper limit value, values corresponding to the apparatus type information are referred to. When it is determined that the reference value is the upper limit value, the control section 110 ends the maintenance control process. Meanwhile, when it is determined that the reference value is not the upper limit value, the control section 110 determines a reference value to which a predetermined value is added and sets the determined reference value (step S47). The predetermined value is a value corresponding to the apparatus type information, and is a value which does not exceed the sheet number upper limit value and the time upper limit value.

Then, in step S48, the control section 110 initializes the continuous periodic number counter assigned to the storage section 120, and ends the maintenance control process. As described above, when the periodic maintenance is performed continuously the specified number of times, the continuous periodic number counter is initialized. As such, when the periodic maintenance is continuously performed a specified number of times, the predetermined value is added to the reference value with the upper limit value as an upper limit. Therefore, even when the user maintenance is performed and the reference value is reduced, the reference value is increased by continuously performing the periodic maintenance a specified number of times.

As such, the cleaning intensity in the user maintenance, and the ejection amount of the idle ejection can be different between the first mode and the second mode. Particularly, in the first mode, it is estimated that ink is poured from the commercially available ink bottle 31 into the ink accommodation body 18, and in the second mode, ink is poured from the ink bottle 31 for subscription into the ink accommodation body 18. Accordingly, in the first mode, it is possible to avoid an increase in a consumption amount of ink being poured from the commercially available ink bottle 31 in the user maintenance. Meanwhile, in the second mode, it is possible to increase maintenance intensity by increasing a consumption amount of ink being poured from the ink bottle 31 for subscription in the user maintenance.

Further, in the first mode, the reference value satisfying the execution condition of the periodic maintenance is constant and cannot be changed. Meanwhile, in the second mode, the reference value satisfying the execution condition of the periodic maintenance can be changed. Accordingly, in the first mode, the periodic maintenance is performed based on the constant reference value, and thereby, it is possible to suppress a reduction in an interval of the periodic maintenance, and to reduce a consumption amount of ink being poured from the commercially available ink bottle 31. Meanwhile, in the second mode, the reference value can be changed based on the count value counted until the user maintenance is performed. Then, the interval of the periodic maintenance can be reduced by performing the periodic maintenance based on the changed reference value, and maintenance intensity can be increased by sufficiently consuming ink being poured from the ink bottle 31 for subscription.

Next, an accommodation amount notification process executed by the printing apparatus 11 will be described. This accommodation amount notification process is executed by the control section 110 of the printing apparatus 11 every predetermined interval.

Figure 9:
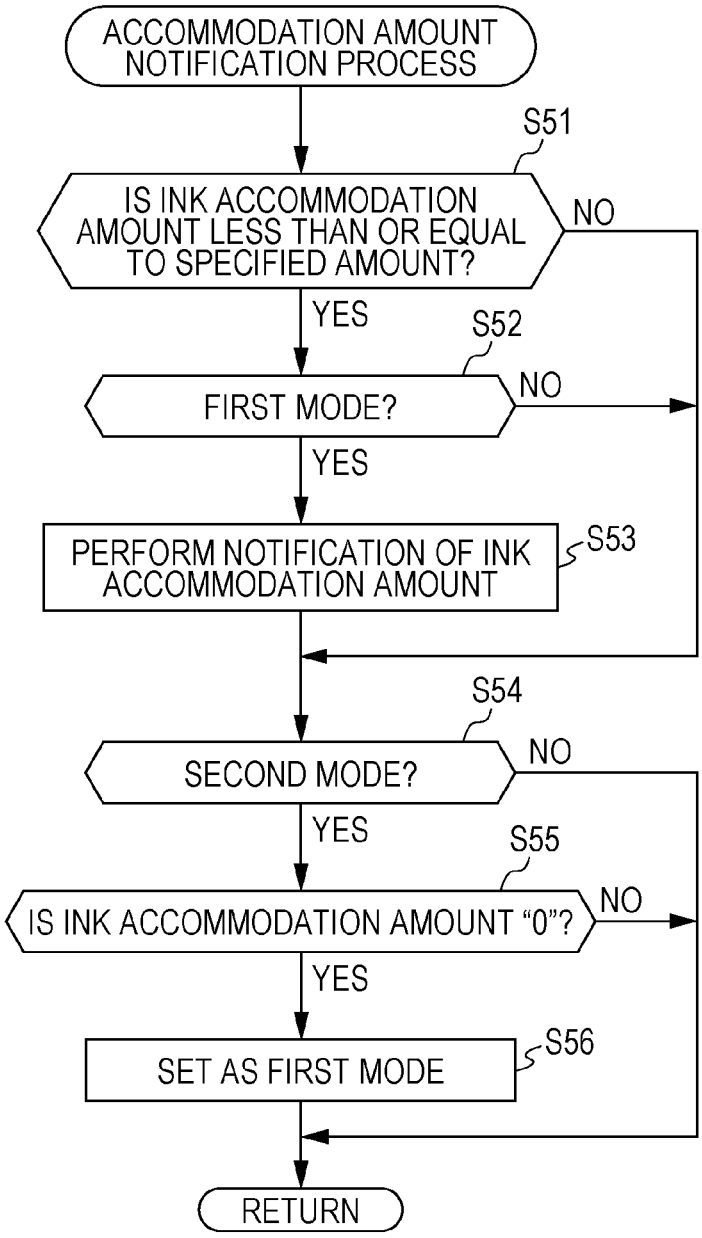
FIG. 9 is a flowchart illustrating an accommodation amount notification process executed by a control section of the printing apparatus.

As illustrated in FIG. 9, the control section 110 determines whether or not an accommodation amount of the ink accommodation body 18 is less than or equal to a specified amount based on a value of the ink bottle counter. That is, the control section 110 determines whether or not a remaining amount of ink filled in the ink bottle 31 is less than or equal to the specified amount. In other words, it is determined whether or not the total ink remaining amount of the ink bottle 31 and the ink accommodation body 18 of a pouring destination thereof is less than or equal to the specified amount. If it is determined that the accommodation amount of the ink accommodation body 18 is not less than or equal to the specified amount, the control section 110 proceeds to step S54 without executing steps S52 and S53. Meanwhile, if it is determined that the accommodation amount of the ink accommodation body 18 is less than or equal to the specified amount, the control section 110 proceeds to step S52.

In step S52, the control section 110 reads the information stored in the mode flag and determines whether or not in the first mode. When it is determined not to be in the first mode, the control section 110 proceeds to step S54 without executing step S53. Meanwhile, when it is determined to be in the first mode, the control section 110 causes the display section 16 to perform notification of the ink accommodation amount by causing the display section 16 to display an image indicating that the ink accommodation amount is less than or equal to the specified amount (step S53), and proceeds to step S54. As such, the display section 16 displays an accommodation amount of the liquid accommodated in the ink accommodation body 18. Then, when the accommodation amount of the ink accommodated in the ink accommodation body 18 is less than or equal to the specified amount, the control section 110 does not display on the display section 16 that the accommodation amount is less than or equal to the specified amount in the second mode and displays on the display section 16 that the accommodation amount is less than or equal to the specified amount in the first mode.

This is because, as for a commercially available ink bottle 31, when the amount of ink accommodated in the ink accommodation body 18 is less than or equal to the specified amount, it is necessary to make preparation such as purchasing a new ink bottle 31 and to make preparation of purchasing a new commercially available ink bottle 31 before reaching ink end at which ink in the ink bottle 31 is completely consumed. Accordingly, in the first mode, the display section 16 displays that the accommodation amount is less than or equal to the specified amount. Specifically, in the first mode, the display section 16 displays that a total value of the remaining amount of the ink bottle 31 and the remaining amount of ink in the ink accommodation body 18 is less than or equal to the specified amount. That is, in the present example, the display section 16 displays that the total value of the remaining amount of the ink bottle 31 and the ink remaining amount of the ink accommodation body 18 is less than or equal to a near end which is an example of the specified amount. For example, in a state where the remaining amount of ink bottle 31 is more than a predetermined amount, even if the ink in the ink accommodation body 18 is less than the specified amount, the fact is not displayed on the display section 16, and in a state where the remaining amount of the ink bottle 31 is "0", when the ink in the ink accommodation body 18 is less than or equal to the specified amount, the fact is displayed on the display section 16.

Meanwhile, as for the ink bottle 31 for subscription, even when an accommodation amount of the ink accommodated in the ink accommodation body 18 is less than or equal to the specified amount, a new ink bottle 31 is delivered, and thus, it is unnecessary to reduce consumption of ink, and in the second mode, the display section 16 need not display that the accommodation amount is less than or equal to the specified amount. That is, in the second mode, even if the total value of the remaining amount of the ink bottle 31 and the ink remaining amount of the ink accommodation body 18 is less than or equal to the specified amount, the fact is not displayed on the display section 16. In the present example, in the second mode, the display section 16 does not display that the accommodation amount is less than or equal to the near end which is an example of the specified amount. The control section 110 monitors the remaining amount of the ink accommodation body 18 with the value of the ink counter, and if the remaining amount of the ink accommodation body 18 is less than or equal to the specified amount, information that prompts a user to pour ink from the ink bottle 31 into the ink accommodation body 18 may be displayed on the display section 16. In this case, it is preferable that the information displayed on the display section 16 be different between when the value of the ink bottle counter is less than or equal to the specified amount and when the value of the ink accommodation body is less than or equal to the specified amount.

Next, in step S54, the control section 110 reads information stored in the mode flag and determines whether or not in the second mode. When it is determined not to be in the second mode, the control section 110 ends the accommodation amount notification process without executing steps S55 and S56. Meanwhile, when it is determined to be in the second mode, the control section 110 proceeds to step S55.

In step S55, the control section 110 determines whether or not the value of the ink bottle counter is "0" and the accommodation amount of the ink accommodation body 18 is "0". That is, the control section 110 determines whether or not a remaining amount of the ink filled in ink bottle 31 is "0". In other words, it is determined whether or not a total ink remaining amount of the ink bottle 31 and the ink accommodation body 18 of a pouring destination thereof is "0" indicating the ink end. When it is determined that the accommodation amount of the ink accommodation body 18 is not "0", the control section 110 ends the accommodation amount notification process without executing step S56. Meanwhile, when it is determined that the accommodation amount of the ink accommodation body 18 is "0", the control section 110 sets information indicating the first mode in the mode flag (step S56), and ends the accommodation amount notification process. As such, when reaching timing in which it is estimated that consumption of the ink filled in the ink bottle 31 for subscription is completed, the control section 110 sets the first mode. Such a process is executed by the mode control section 111 of the control section 110.

An operation of the printing system 10 will be described. When the printing apparatus 11 is used for the first time, the printing apparatus 11 is set to the first mode. Thereby, when the printing apparatus 11 is used for the first time, an operation in the first mode is performed.

Meanwhile, the ink bottle 31 for subscription is delivered to a user whose subscription information is valid. Then, ink filled in the delivered ink bottle 31 for subscription is poured into the ink accommodation body 18. Further, when an authentication instruction is issued, authentication information involved in the delivered ink bottle 31 is read by the image reading section 13, and authentication-related information including the authentication information is transmitted to the server apparatus 200.

Meanwhile, when receiving the authentication-related information, the server apparatus 200 performs collation with the authentication information registered in the user information database DB, and transmits authentication result information indicating an authentication result to the printing apparatus 11. Particularly, as a result of the collation, when a correct authentication is performed, a permission condition is satisfied, and when the correct authentication is not performed, the permission condition is not satisfied.

When the printing apparatus 11 receives the authentication result information indicating that the correct authentication is performed and determines that the correct authentication is performed, the permission condition is satisfied and a control in the second mode is made. Thereby, when the authentication information involved in the delivered ink bottle 31 for subscription is correct authentication information and is not correctly authenticated according to communication with the server apparatus 200, the permission condition is satisfied, and the operation in the second mode is performed.

When the printing apparatus 11 receives the authentication result information indicating that the correct authentication is not performed and determines that the correct authentication is not performed, the permission condition is not satisfied, a control in the second mode is not made, and the control in the first mode is continued. Thereby, when the authentication information involved in the delivered ink bottle 31 for subscription is not the correct authentication information and is not correctly authenticated according to communication with the server apparatus 200, the permission condition is not satisfied, and the operation in the first mode is performed.

In the operation of the first mode, cleaning is performed at a constant cleaning intensity, and idle ejection is performed with a constant ejection amount. Further, in the operation of the first mode, an interval at which the periodic maintenance is performed does not change. Then, in the operation of the first mode, when the ink accommodation amount is less than or equal to the specified amount, an image indicating that the ink accommodation amount is less than or equal to the specified amount is displayed on the display section 16.

Meanwhile, in the operation of the second mode, the cleaning is performed with a cleaning intensity corresponding to the count value counted from the previous maintenance to the time when the user maintenance is performed. In the operation of the second mode, the idle ejection is performed with the ejection amount corresponding to the count value counted from the previous maintenance to the time when the user maintenance is performed. Further, in the operation in the second mode, a periodic maintenance interval is shortened to the interval corresponding to the count value counted from the previous maintenance to the time when the user maintenance is performed, the user maintenance is not performed, and the interval in which the periodic maintenance is performed is extended according to the number of times in which the periodic maintenance is continuously performed. Then, in the operation of the second mode, even when the ink accommodation amount is less than or equal to the specified amount, an image indicating that the ink accommodation amount is less than or equal to the specified amount is not displayed on the display section 16.

As described above in detail, according to the present embodiment, the following effects can be obtained.

(1) Printing is performed by using ink supplied from the ink accommodation body 18. When authentication information on the ink bottle 31 for pouring ink into the ink accommodation body 18 is authentication information other than authentication information for subscription, the operation of the first mode is performed. Meanwhile, in a case where the authentication information is for subscription, when a permission condition is satisfied according to the communication with the server apparatus 200, the operation of the second mode is performed. Accordingly, the operating mode can be changed depending on the type of the authentication information involved to the ink bottle 31 and the communication with the server apparatus 200 according to whether or not the authentication, according to the ink accommodation body 18 is the authentication information for subscription. The printing apparatus 11 can be operated in an appropriate mode according to whether the subscription is invalid first information or valid second information among a plurality of modes.

(2) Further, when the authentication information on the ink accommodation body 18 is the authentication information for subscription, a permission condition according to communication with the server apparatus 200 can be provided as a condition for performing the operation of the second mode, and the operation of the second mode can be performed in a suitable situation in which the permission condition is satisfied according to the communication with the server apparatus 200.

(3) When the authentication information is for subscription, the authentication information for determining whether or not the permission condition is satisfied is transmitted to the server apparatus 200, and the permission condition is satisfied when determination result information indicating that the permission condition is satisfied is received from the server apparatus 200. Accordingly, the printing apparatus 11 transmits the authentication information for determining whether or not the permission condition is satisfied to the server apparatus 200, and if the determination result information indicating that the permission condition is satisfied can be received from the server apparatus 200, it is not necessary to determine whether or not the permission condition is satisfied, and it is possible to recognize that the permission condition is satisfied according to the communication with the server apparatus 200.

(4) Particularly, since the authentication information is collated by the server apparatus 200, the authentication information can be intensively managed by the server apparatus 200, and also, the printing apparatus 11 does not need to execute a process of collating the authentication information and can reduce a control load.

(5) The ink accommodation body 18 is configured to be capable of pouring the ink filled in the ink bottle 31 and to perform printing by ejecting the ink supplied from the ink accommodation body 18. Then, by acquiring the authentication information on the ink accommodation body 18, the operation mode can be changed depending on the type of the authentication information and the communication with the server apparatus 200, and an operation can be made in a mode suitable for a user among the plurality of modes.

(6) When the authentication information on the ink accommodation body 18 is the authentication information for subscription, by using the authentication information capable of identifying the ink bottle 31, a permission condition based on the authentication information can be provided according to the communication with the server apparatus 200 as a condition for performing the operation in the second mode. Therefore, according to the communication with the server apparatus 200, the operation in the second mode can be performed in a suitable situation in which the permission condition based on the authentication information is satisfied.

(7) When an accommodation amount of ink accommodated in the ink accommodation body 18 is less than or equal to the specified amount, the display section 16 does not display that the accommodation amount is less than or equal to the specified amount in the second mode, but the display section 16 displays that the accommodation amount is less than or equal to the specified amount in the first mode. Accordingly, when the accommodation amount of the ink accommodated in the ink accommodation body 18 is less than or equal to the specified amount, whether or not to display on the display section 16 that the accommodation amount is less than or equal to the specified amount can be changed depending on the type of the mode. Therefore, according to the type of the authentication information involved in the ink bottle 31 and the communication with the server apparatus 200, whether or not to issue a notice that the accommodation amount is less than or equal to the specified amount can be changed and an operated can be performed in a mode suitable for a user.

Second Embodiment

Hereinafter, a second embodiment will be described. The first embodiment provides a configuration in which the ink filled in the ink bottle 31 is poured into the ink accommodation body 18, but instead of this, the second embodiment provides a configuration in which an ink cartridge accommodating ink can be attached and detached instead. In the second embodiment, descriptions on the same configuration as the configuration of the first embodiment will be omitted. Further, in the second embodiment, the description on the ink bottle 31 of the first embodiment may be exchanged with description on an ink cartridge 67 in some cases.

Figure 10:
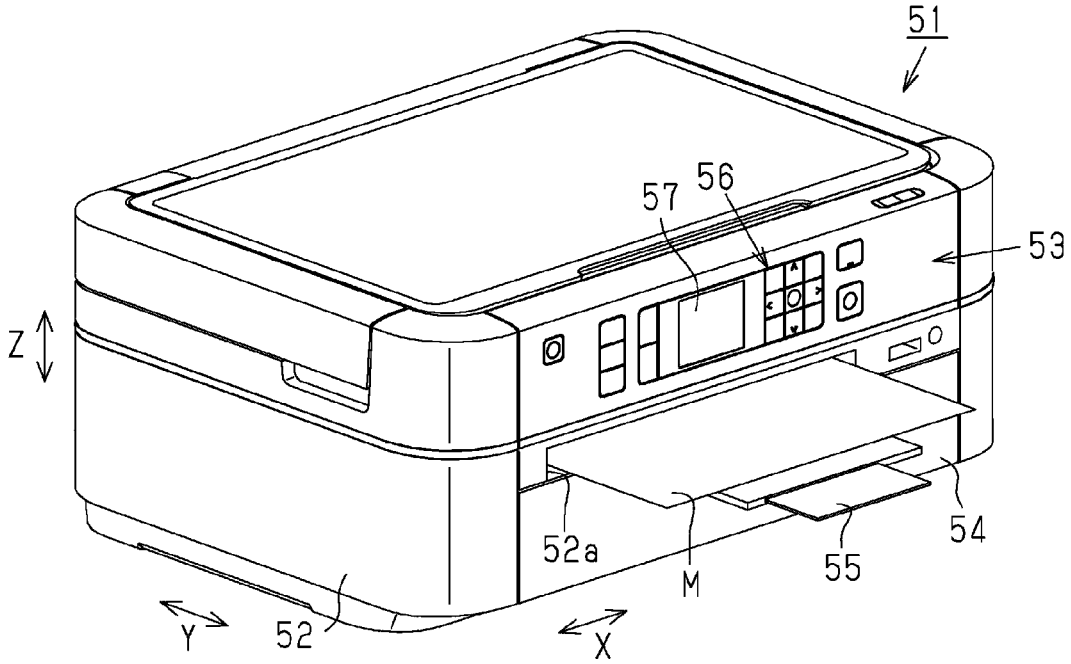
FIG. 10 is a perspective view illustrating a printing apparatus according to a second embodiment.

As illustrated in FIG. 10, a printing apparatus 51 includes a main body 52 having substantially rectangular box shaped, and an operation panel 53 is provided on an upper front surface of the main body 52. The operation panel 53 includes an operation section 56 for a user to operate, and a display section 57 on which various menus are displayed. The display section 57 also displays message information for prompting the user to run out of ink and exchange the ink cartridge. Further, a paper feeding cassette 54 capable of accommodating a plurality of media M such as paper sheets is mounted in the main body 52 on a lower side of the operation panel 53 in a state of being insertable and withdrawable. The printing apparatus 51 performs printing on the medium M fed from the paper feeding cassette 54, and discharges the printed medium M from a discharge hole 52*a* opened in a front surface of the main body 52 onto a slide-type discharge tray 55.

Figure 11:
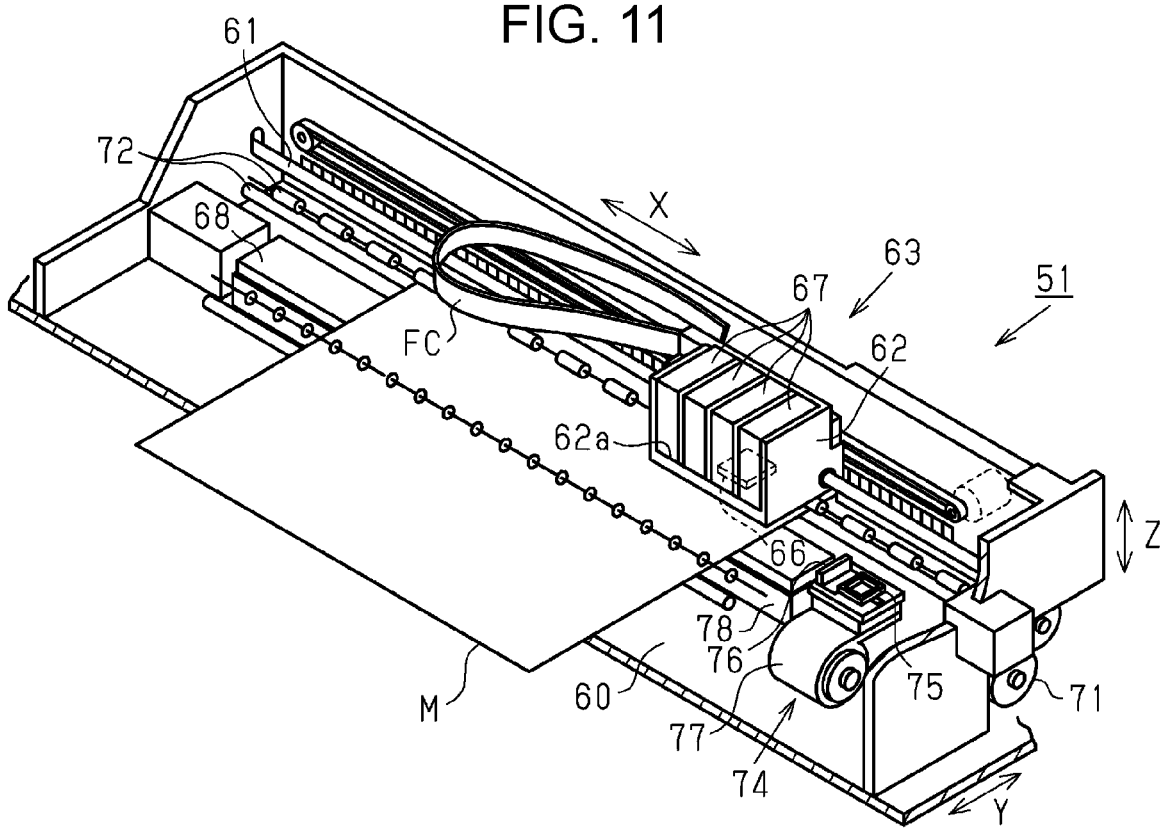
FIG. 11 is a perspective view illustrating a printing apparatus according to the second embodiment.

As illustrated in FIG. 11, a guide shaft 61 having a predetermined length is installed between left and right side walls of a substantially rectangular box-shaped main body frame 60 having upper and front sides opened in the printing apparatus 51, and a carriage 62 is provided with the guide shaft 61 is provided to be able to reciprocate in a width direction X along the guide shaft 61.

A liquid ejecting head 66 is provided below the carriage 62. The printing section 63 that prints on the medium M is configured to include the carriage 62 and the liquid ejecting head 66. Further, ink cartridges 67 which are a plurality (four in the example of FIG. 11) of printing material accommodation body and an example of a liquid accommodation body are mounted on a cartridge holder 62*a* concavely provided above the carriage 62. Each ink cartridge 67 accommodates four color inks of, for example, black (K), cyan (C), magenta (M), and yellow (Y), which are liquids as printing materials. Of course, the number of ink colors is not limited to four, and may be one, two, and five to eight. In this case, the number of ink cartridges 67 to be mounted can be changed to a certain number corresponding to the number of ink colors among one to eight. The cartridge holder 62*a* to which the ink cartridges 67 can be attached and detached corresponds to an example of a mounting section.

The liquid ejecting head 66 ejects ink supplied from each ink cartridge 67 from nozzles for each color opened on a lower surface thereof. As such, the liquid ejecting head 66 performs printing by ejecting the ink accommodated in the ink cartridge 67 mounted on the cartridge holder 62*a*. The liquid ejecting head 66 is communicably coupled to a control section (not illustrated) provided in the printing apparatus 51 via a flexible flat cable FC coupled to the carriage 62, and is driven based on ejection control data from the control section.

At a lower position facing the liquid ejecting head 66, a long support base 68 that specifies an interval (gap) between the liquid ejecting head 66 and the medium M is provided. The support base 68 extends in the width direction X at least over a printing area. During printing, ink ejected from a plurality of nozzles opened on a lower surface of the liquid ejecting head 66 lands on a place of the medium M on the support base 68, and thereby, a character or an image is printed.

Further, a transport motor 71 is disposed on the lower right side of the main body frame 60 in FIG. 11. A transport roller pair 72 is disposed on an upstream side of the support base 68 across the support base in a depth direction Y. As the transport motor 71 is rotationally driven, the medium M is transported in the depth direction Y in a state of being nipped by the transport roller pair 72. The printing apparatus 51 of a serial type illustrated in FIG. 11 prints a character or an image on the medium M by alternately repeating a printing operation of ejecting ink from the nozzles of the liquid ejecting head 66 onto the medium M while the carriage 62 reciprocates in the width direction X, and a feeding operation of transporting the medium M by a predetermined transport amount in the depth direction Y.

In FIG. 11, one end position (a right end position in FIG. 11) on a movement path of the carriage 62 is a home position. A maintenance apparatus 74 that performs maintenance such as cleaning of the liquid ejecting head 66 is provided at a position corresponding to a position immediately below the carriage 62 when located at the home position. The maintenance apparatus 74 includes a cap 75, a wiper 76, a maintenance pump 77, and the like, and drives the maintenance pump 77 in a state where the cap 75 is in contact with a nozzle forming surface that is a lower surface of the liquid ejecting head 66 disposed at the home position, and performs cleaning of forcibly sucking and discharging ink from the nozzles of the liquid ejecting head 66. Waste ink sucked and discharged from the nozzles of the liquid ejecting head 66 by the maintenance apparatus 74 is discharged to a waste liquid tank 78 disposed on a lower side of the support base 68. Cleaning may be pressurization cleaning instead of suction cleaning.

Figure 5:
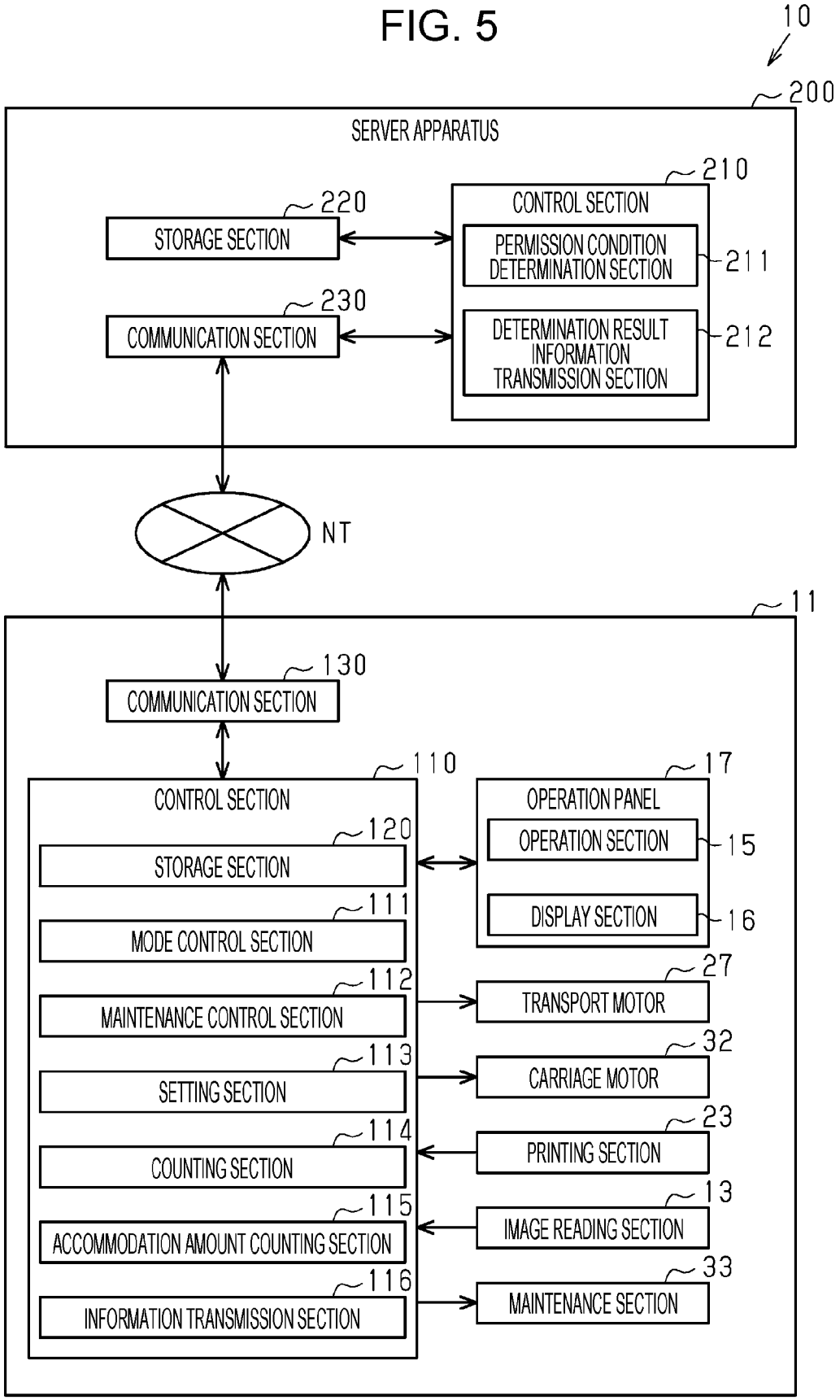
FIG. 5 is a block diagram illustrating an electrical configuration of the printing system according to the first embodiment.

In the second embodiment, the control section 110 in FIG. 5 includes a cartridge management section as a functional section functioning by executing a control program. The cartridge management section manages the ink cartridge 67 mounted on the carriage 62. The cartridge management section accesses a memory element configured by an integrated circuit (not illustrated) provided in the ink cartridge 67 via a communication line, reads ink cartridge management information at the time of a power-on process, and writes an accumulated value of an ink accommodation amount (consumed amount) counted by an accommodation amount counting section 115 to a memory element at a predetermined time period during power-on and at the time of a power-off process. Further, the cartridge management section reads accommodation body identification information, accommodation body type information, and authentication information stored in the memory element provided in the ink cartridge 67, and can recognize whether the ink cartridge 67 is a commercially available ink cartridge or an ink cartridge 67 for subscription. The accommodation amount counting section 115 includes various counters assigned to the storage section 120. The accommodation amount counting section 115 includes an ink counter that counts an ink consumption amount from timing when authentication information on the new ink cartridge 67 is authenticated by the server apparatus 200. The accommodation amount counting section 115 does not include an ink bottle counter.

If the ink cartridge 67 is mounted on the cartridge holder 62*a* of the carriage 62, a first electrode provided on an inner surface of the cartridge holder 62*a* and a second electrode provided in the ink cartridge 67 are electrically coupled to each other. The control section 110 accesses the memory element of the ink cartridge 67 via electrical coupling between the first electrode and the second electrode coupled to a communication line.

In the second embodiment, the same content as the user information database DB of the first embodiment illustrated in FIG. 6 is basically registered in the user information database DB stored in the storage section 220 of the server apparatus 200. In the first embodiment, the user information database DB includes container identification information, container type information, and authentication information relating to the ink bottle 31 as an example of a liquid container, but instead of these pieces of information, accommodation body information, accommodation body type information, and authentication information relating to the ink cartridge 67 as an example of a liquid accommodation body are included. Accommodation body identification information, the accommodation body type information, and the authentication information of the user registered in the user information database DB are stored in a memory element provided in the ink cartridge 67 for subscription.

In the second embodiment, the control section 110 executes an authentication process when the ink cartridge 67 is mounted on the cartridge holder 62*a*. An authentication process of the second embodiment is basically the same as the authentication process of the first embodiment illustrated in FIG. 7. Further, a maintenance control process of the second embodiment is basically the same as the maintenance control process of the first embodiment illustrated in FIG. 8. Further, an accommodation amount notification process of the second embodiment is basically the same as the accommodation amount notification process of the first embodiment illustrated in FIG. 9. First, as for the authentication process, items different from the authentication process of the first embodiment will be mainly described.

In step S11 of FIG. 7, the control section 110 reads the accommodation body identification information, the accommodation body type information, and the authentication information from a memory element of the ink cartridge 67, and determines whether the ink cartridge 67 is a commercially available ink cartridge or an ink cartridge for subscription. In the present example, whether the ink cartridge 67 is the commercially available ink cartridge 67 or the ink cartridge 67 for subscription is determined based on the accommodation body type information but may be determined based on any one of the accommodation body identification information, the accommodation body type information, and the authentication information.

When it is determined to be the commercially available ink cartridge 67, the control section 110 does not transmit the authentication information to the server apparatus 200, proceeds to step S17 to set a first mode, and ends the authentication process. Meanwhile, when it is determined to be the ink cartridge 67 for subscription, the control section 110 proceeds to step S12. Then, in step S12, the control section 110 performs an authentication-related information transmission process. In the next step S13, the control section 110 determines whether or not a correct authentication is performed. If the correct authentication is performed, the process proceeds to step S14 to set a second mode. In the next step S15, the control section 110 performs an ink cartridge information registration process. In the present example, when the ink cartridge 67 is neither the commercially available ink cartridge 67 nor the ink cartridge 67 for subscription, the operation of the printing apparatus 11 may be stopped. As such, information on the commercially available ink cartridge 67 corresponds to an example of first information, and information on the ink cartridge 67 for subscription corresponds to an example of second information.

Further, in the printing control process, when controlled to the second mode, the control section 110 of the printing apparatus 11 subtracts a value indicating a consumption amount of ink consumed for each color of ink from an ink counter assigned to the storage section 120, based on the printed image data as a result of execution of the printing process. The ink counter indicates an accommodation amount (remaining amount) of ink accommodated in the ink cartridge 67. The control section 110 subtracts a value indicating a consumption amount of ink discharged from the printing section 63 for maintenance of nozzles of the printing section 63 from the ink counter, and counts a remaining amount (consumption amount) of the ink filled in the delivered ink cartridge 67. Accordingly, the control section 110 counts the amount of consumed ink, subtracts the counted result from the ink counter, thereby being capable of recognizing the remaining amount of the ink filled in the delivered ink cartridge 67. Then, the control section 110 writes the accommodation amount stored in the ink counter to a memory element of the ink cartridge 67.

Further, in the accommodation amount notification process, the control section 110 of the printing apparatus 11 determines whether or not the accommodation amount stored in the ink counter is less than or equal to the specified amount (step S51) and determines whether or not the accommodation amount is "0" (step S55). The control section 110 executes processes of the other steps S52 to S54 and S56 in the same manner as in the first embodiment.

Further, the control section 110 executes a maintenance control process illustrated in FIG. 8. In this maintenance control process, the control section 110 executes the same process as in the first embodiment. First, in step S21, the control section 110 determines whether or not the execution condition of the user maintenance is satisfied. When the execution condition of the user maintenance is satisfied, whether or not in the second mode is determined in step S22. When in the second mode, a count value from the previous maintenance is acquired (step S23), intensity corresponding to the count value is determined (step S24), and an ejection amount corresponding to the count value is determined (step S25). When in the second mode, in the next step S26, the control section 110 performs cleaning with intensity corresponding to the previously determined count value, performs idle ejection with the ejection amount corresponding to the previously determined count value, and thereby, a maintenance process is performed (step S26). Meanwhile, when in the first mode, the cleaning process is performed at a constant intensity irrespective of the count value, the idle ejection is performed with a constant ejection amount irrespective of the count value, and thereby, the maintenance process is performed (step S26).

Further, in step S31, the control section 110 determines whether or not in the second mode. When not in the second mode, the control section 110 ends the maintenance control process. Meanwhile, when in the second mode, in step S32, the control section 110 determines whether or not the count value is less than a lower limit value. The control section 110 determines whether or not the count value is less than the lower limit value. When it is determined that the count value is not less than the lower limit value, the control section 110 sets the count value as the reference value (step S33), and meanwhile, when it is determined that the count value is less than the lower limit value, the control section 210 sets the lower limit value as the reference value (step S34). The control section 110 initializes the continuous periodic number counter (step S35) and ends the maintenance control process.

Meanwhile, when the execution condition of the user maintenance is not satisfied in step S21, in step S41, the control section 110 determines whether or not the execution condition of the periodic maintenance is satisfied. When the count value of the counting section 114 is greater than or equal to the reference value, the control section 110 determines that the execution condition of the periodic maintenance is satisfied. Specifically, the same process as in the first embodiment is performed. If the execution condition of the periodic maintenance is satisfied, in step S42, the control section 110 executes the maintenance process as in step S26, and initializes the count value of the counting section 114. Further, in the periodic maintenance, the control section 110 performs cleaning with a predetermined constant intensity in the same manner as in the first mode and in the second mode.

When in the second mode (positive determination in S43), "1" is added to the continuous periodic number counter (step S44), and if the continuous periodic number counter becomes the specified number (positive determination in S45), and if the reference value is not an upper limit value (negative determination in S46), a reference value obtained by adding a predetermined value is set (step S47), and the continuous periodic number counter is initialized (step S48). As such, when the periodic maintenance is continuously performed a specified number of times, the predetermined value is added to the reference value with the upper limit value as an upper limit. Therefore, even when the user maintenance is performed and the reference value is reduced, the reference value is increased by continuously performing the periodic maintenance a specified number of times.

As such, the cleaning intensity in the user maintenance, and the ejection amount of the idle ejection can be different between the first mode and the second mode. Particularly, when in the first mode, it is estimated that the ink cartridge 67 is a commercially available ink cartridge, and when in the second mode, it is estimated that the ink cartridge 67 is an ink cartridge for subscription. Accordingly, when in the first mode, it is possible to avoid an increase in ink consumption amount of the commercially available ink cartridge 67 in the user maintenance. Meanwhile, when in the second mode, in the user maintenance, the maintenance intensity can be increased by increasing the ink consumption amount of the ink cartridge 67 for subscription.

As described above in detail, according to the present embodiment, the following effects can be obtained.

(8) In a configuration in which printing is performed by ejecting ink accommodated in the ink cartridge 67 mounted on the cartridge holder 62*a*, accommodation body type information and the like relating to the ink cartridge 67 are acquired. Thereby, an operation mode can be changed depending on the type of the ink cartridge 67 and the communication with the server apparatus 200, and the printing apparatus 11 can be operated in an appropriate mode depending on whether subscription is valid or invalid among the plural types of modes. Further, according to the second embodiment, the effects (1) to (4), (6), and (7) of the first embodiment can be obtained in the same manner.

The embodiments described above can be changed to forms such as the following modification examples. Furthermore, one which is obtained by appropriately combining the embodiments described above and the following modification examples may be another modification example, or one which is obtained by appropriately combining the following modification examples may be further another modification example.

In the first embodiment and the second embodiment, for example, determination result information transmitted from the server apparatus 200 to the printing apparatus 11 when requesting authentication is not information on whether or not the permission condition is satisfied, but may be determination result information indicating whether or not the authentication information matches as a result of collation. In this case, the control section 110 of the printing apparatus 11 may receive the determination result information and determine whether or not the permission condition is satisfied.

In the first embodiment and the second embodiment, for example, when the acquired authentication information is authentication information for subscription, the control section 110 of the printing apparatus 11 may request transmission of the authentication information to the server apparatus 200, collates the acquired authentication information with the authentication information from the server apparatus 200, and determine whether or not the permission condition is satisfied. As such, the printing apparatus 11 includes a permission condition determination section that determines whether or not the permission condition is satisfied based on the authentication information transmitted from the server apparatus 200. Such a process is executed by the permission condition determination section of the control section 110. In this case, when transmission of the authentication information is requested from the printing apparatus 11, the control section 210 of the server apparatus 200 transmits the authentication information corresponding to the apparatus identification information of the printing apparatus 11 to the printing apparatus 11. As such, when the transmission of the authentication information is requested from the printing apparatus 11, the server apparatus 200 includes a determination information transmission section that transmits the authentication information to the printing apparatus 11. Such a process is executed by the determination information transmission section of the control section 210. Thereby, when the authentication information is the authentication information for subscription, the control section 110 of the printing apparatus 11 requests the server apparatus 200 for the authentication information for determining whether or not the permission condition is satisfied. Thereby, the control section 110 of the printing apparatus 11 can determine whether or not the permission condition is satisfied based on the authentication information transmitted from the server apparatus 200, and recognize that the permission condition is satisfied according to the communication with the server apparatus 200.

In the embodiments described above, for example, when the value of the ink bottle counter is "0", the control section 110 does not have to set the second mode to the first mode. Further, in this case, for example, while continuing the second mode, printing may be stopped until a correct authentication is performed or until the first mode is controlled.

In the embodiments described above, for example, the printing apparatus 11 may include an accommodation amount detection section that detects an accommodation amount of ink accommodated in the ink accommodation body 18 or the ink cartridge 67, and the control section 110 may determine an accommodation amount of ink accommodated in the ink accommodation body 18 or the ink cartridge 67 based on a result detected by the accommodation amount detection section. Then, when the accommodation amount of the ink accommodated in the ink accommodation body 18 or the ink cartridge 67 is less than or equal to the specified amount, or when the accommodation amount is "0", the control section 110 may execute various processes in the embodiments described above.

In the embodiments described above, for example, even when the ink accommodation body of some of a plurality of colors is subscription and the ink accommodation body of the other of the plurality of colors is not subscription, the subscription information may be registered as valid. In other words, if the ink accommodation body of some of a plurality of colors is subscription, a second mode may be set.

In the embodiments described above, for example, when a power supply is turned on, the authentication information may be acquired from the ink cartridge 67, and the authentication process may be executed. Further, for example, when the power supply is turned off, the authentication information may be acquired from the ink cartridge 67, and the authentication process may be executed. Further, for example, authentication may be requested in the above opportunity for the ink bottle 31 in the same manner.

in the embodiments described above, for example, when the power supply is turned on in the second mode, and when an authentication condition is satisfied, the authentication information may be acquired from the ink cartridge 67 and the authentication process may be executed. Here, as a specific authentication condition, when at least one of the time when a predetermined time elapses, the time when a predetermined amount of ink is consumed, and the time when printing of a predetermined number of sheets is performed, is established, the authentication process may be executed. Meanwhile, for example, when the power supply is turned on in the first mode, the authentication process may not be executed except when the ink cartridge 67 is exchanged.

In the first embodiment, for example, when an authentication image is also involved in the commercially available ink bottle 31 and authentication information included in the authentication image is authentication information of the commercially available ink bottle 31, the authentication-related information included in the authentication information may be transmitted to the server apparatus 200. In this case, when it is determined that the authentication information included in the authentication-related information is the authentication information of the commercially available ink bottle 31, the control section 210 of the server apparatus 200 determines that a determination condition is not satisfied and may transmit the determination result information which is referred to as the authentication information of the commercially available ink bottle 31. Then, if the control section 110 receives the determination result information that is referred to as the authentication information of the commercially available ink bottle 31, the control section 110 of the printing apparatus 11 sets the first mode. The authentication information of the commercially available ink bottle 31 corresponds to an example of first information. In this case, for example, when it is determined to be the authentication information of the commercially available ink bottle 31, the first mode is set, but when the authentication information is neither the authentication information of the commercially available ink bottle 31 nor the authentication information for subscription, an operation of the printing apparatus 11 may be stopped. In this case, for example, an operation of the image reading section 13 or an operation of a facsimile may be stopped or may not be stopped.

In the embodiments described above, for example, when it is determined that the authentication information acquired by the printing apparatus 11 is not the authentication information of the ink bottle 31 or the ink cartridge 67 for the subscription, the authentication-related information may be transmitted to the server apparatus 200.

in the embodiments described above, for example, authentication information for the printing apparatus 11 to determine whether the ink bottle 31 or the ink cartridge 67 is for subscription or for commercial availability, and authentication information transmitted from the printing apparatus 11 to the server apparatus 200 when an authentication request is made may be the same or different.

In the embodiments described above, for example, the authentication information may be authentication information capable of identifying the printing apparatus 11 or may be a combination with the authentication information in the delivered ink bottle 31 or the ink cartridge 67 for subscription.

in the embodiments described above, for example, the authentication information may be acquired by inputting an authentication code according to operations of the operation sections 15 and 56.

in the embodiments described above, for example, when the control is made from the first mode to the second mode, maintenance may be performed. In this case, cleaning intensity and an ejection amount of idle ejection may be greater when the maintenance is performed as the operation in the second mode than when the maintenance is performed as the operation in the first mode.

in the embodiments described above, for example, the destination information (installation destination information) is stored in the server apparatus 200, and in the second mode, at least one of an execution condition of periodic maintenance, cleaning intensity, and an ejection amount of idle ejection may be changed for each destination information. Further, for example, the destination information is stored in the printing apparatus 11 itself, and in the second mode, at least one of the execution condition of the periodic maintenance, the cleaning intensity, and the ejection amount of the idle ejection may be changed for each destination information.

in the embodiments described above, for example, calendar information and weather tendency are stored in the server apparatus 200, and in the second mode, at least one of the execution condition of the periodic maintenance, the cleaning intensity, and the ejection amount of the idle ejection may be changed according to date and time (season) and the weather tendency. Further, for example, the calendar information and the weather tendency are stored in the printing apparatus 11, and in the second mode, at least one of the execution condition of the periodic maintenance, the cleaning intensity, and the ejection amount of the idle ejection may be changed according to the date and time (season) and the weather tendency.

in the embodiments described above, for example, the printing apparatus 11 includes an environment information detection section that detects environment information including at least one of temperature and humidity, and the control section 110 may change at least one of the execution condition of the periodic maintenance, the cleaning intensity, and the ejection amount of the idle ejection based on the environment information in the second mode. Of course, the environment information is transmitted from the printing apparatus 11 to the server apparatus 200, and in the second mode, at least one of the execution condition of the periodic maintenance, the cleaning intensity, and the ejection amount of the idle ejection may be changed based on the environment information in the server apparatus 200.

In the embodiments described above, for example, the medium type information on the type of the medium to be printed by the printing apparatus 11 may be acquired, and the medium type information may be transmitted to the server apparatus 200. In this case, the server apparatus 200 may change at least one of the execution condition of the periodic maintenance, the cleaning intensity, and the ejection amount of the idle ejection based on the type of the medium and the frequency of use thereof, in the second mode.

For example, idle wiping for the purpose of removing adhering substances such as paper dust adhering to the nozzle forming surface 25*b* of the ejecting head 25 may be performed as the maintenance. When the count value of the printed-sheet number counter reaches the sheet number reference value, the idle wiping may be performed instead of the cleaning as the periodic maintenance. In the first mode, the number of times of wiping of the idle wiping may be increased more than in the second mode.

in the embodiments described above, for example, when the user maintenance is performed, the cleaning intensity and the ejection amount of the idle ejection corresponding to the count value may be changed in the first mode, but a consumption amount of ink can be preferably reduced more than in the second mode.

in the embodiments described above, for example, even in the first mode, the execution condition of the periodic maintenance, that is, the reference value may be changed, but the reference value is preferably determined such that an interval of the periodic maintenance is longer than in the second mode.

In the embodiments described above, for example, the printing system may include a terminal apparatus capable of communicating with at least one of the printing apparatus 11 and the server apparatus 200. In this case, part or all of the communication between the printing apparatus 11 and the server apparatus 200 may be performed via the terminal apparatus.

In the embodiments described above, the ink can be randomly selected as long as it can be printed on the medium by, for example, adhering to the medium. The ink includes, for example, those obtained by dissolving, dispersing, or mixing particles of a functional material formed of a solid material such as a pigment or metal particles in a solvent, and those containing various compositions such as an aqueous ink, an oil-based ink, a gel ink, and a hot melt ink.

in the embodiments described above, the medium may be, for example, paper, synthetic resin, metal, cloth, ceramic, rubber, or a composite thereof. The medium may be a relatively thick plate, a sheet specified by a thickness of 250 μm or more, a film specified by a thickness of 250 μm or less, a metal foil, or the like. Furthermore, the shape of the medium may be any shape such as a rectangle or a circle. That is, for example, a composite film (resin-impregnated paper, resin-coated paper, or the like) of paper and resin, a composite film (laminated film) of resin and metal, a woven fabric, a nonwoven fabric, a disk, a circuit substrate, or the like may be used.

In the embodiments described above, for example, the printing apparatus may be an apparatus that prints an image of a character, a picture, a photograph, or the like by attaching the liquid such as the ink to the medium, and may include a serial printer, a lateral printer, a line printer, a page printer, or the like. Further, the printing apparatus may be an offset printing apparatus, a textile printing apparatus, or the like. Further, the printing apparatus only needs to have at least a printing function for printing on the medium, and may be a multifunction peripheral having functions other than the printing function. Furthermore, the printing apparatus is may be an apparatus that prints on not only the two-dimensional medium but also a medium having a three-dimensional curved surface.

Hereinafter, technical ideas grasped from the embodiments and the modification examples will be described together with effects.

The printing apparatus is a printing apparatus configured to communicate with a server apparatus via a network, and includes a printing section that performs printing with a printing material accommodated in a printing material accommodation body, a control section that controls printing of the printing section, and an information acquisition section that acquires accommodation body information on the printing material accommodation body, in which the control section performs an operation of a first mode when the accommodation body information acquired by the information acquisition section is first information, and performs an operation of a second mode when a permission condition is satisfied according to communication with the server apparatus in a case in which the accommodation body information acquired by the information acquisition section is second information when a permission condition is satisfied according to communication with the server apparatus.

According to this configuration, an operating mode can be changed by the type of accommodation body information on a printing material accommodation body and communication with a server apparatus according to whether the accommodation body information on the printing material accommodation body is first information or second information, and an operation can be performed in a mode suitable for a user among a plurality of types of modes. Furthermore, when the accommodation body information on the printing material accommodation body is the second information, a permission condition according to the communication with the server apparatus can be provided as a condition for performing an operation of the second mode, and the operation of the second mode can be performed in a suitable situation in which the permission condition is satisfied according to the communication with the server apparatus.

In the printing apparatus described above, when the accommodation body information acquired by the information acquisition section is the second information, the control section transmits determination information for determining whether or not the permission condition is satisfied to the server apparatus, and when determination result information indicating that the permission condition is satisfied is received from the server apparatus, the permission condition is satisfied.

According to this configuration, when accommodation body information is second information, the printing apparatus transmits determination information for determining whether or not the permission condition is satisfied to the server apparatus, and if determination result information indicating that the permission condition is satisfied can be received from the server apparatus, it is unnecessary to determine whether or not the permission condition is satisfied, and the printing apparatus can recognize that the permission condition is satisfied according to communication with the server apparatus.

In the printing apparatus described above, when the accommodation body information acquired by the information acquisition section is the second information, the control section requests the server apparatus to transmit determination information for determining whether or not the permission condition is satisfied, and includes a permission condition determination section that determines whether or not the permission condition is satisfied based on determination information transmitted from the server apparatus.

According to this configuration, when accommodation body information is second information, the printing apparatus can determine whether or not the permission condition is satisfied based on the determination information transmitted from the server apparatus by requesting the server apparatus for the determination information for determining whether or not the permission condition is satisfied, and can recognize that the permission condition is satisfied according to communication with the server apparatus.

In the printing apparatus described above, a mounting section is further included to and from which a liquid accommodation body as the printing material accommodation body is attachable and detachable, and the printing section includes a liquid ejecting head that performs printing by ejecting a liquid as the printing material supplied from the liquid accommodation body mounted on the mounting section.

According to this configuration, in a configuration in which printing is performed by ejecting liquid supplied from a liquid accommodation body mounted on a mounting section, an operation mode can be changed by acquiring accommodation body information on the liquid accommodation body according to the type of the accommodation body information and communication with the server apparatus, and an operation can be performed in a mode suitable for a user among a plurality of types of modes.

In the printing apparatus described above, a liquid as the printing material filled in a liquid container is configured to be injected into a liquid accommodation body as the printing material accommodation body, and the printing section includes a liquid ejecting head that performs printing by ejecting a liquid supplied from the liquid accommodation body.

According to this configuration, in a configuration in which liquid filled in a liquid container can be poured and printing is performed by ejecting liquid supplied from a liquid accommodation body, an operation mode can be changed by acquiring accommodation body information on the liquid accommodation body according to the type of the accommodation body information and communication with the server apparatus, and an operation can be performed in a mode suitable for a user among a plurality of types of modes.

In the printing apparatus described above, the determination information includes authentication information for identifying the accommodation body information, and when the accommodation body information acquired by the information acquisition section is the second information, in a case in which a permission condition based on the authentication information is satisfied, the control section performs the operation of the second mode.

According to this configuration, when accommodation body information on a printing material accommodation body is second information, a permission condition can be provided based on authentication information configured to identify the accommodation body information for each accommodation body information according to communication with the server apparatus as a condition for performing an operation of a second mode. Therefore, an operation of a second mode can be performed in a suitable situation in which a permission condition based on authentication information is satisfied for each accommodation body information, according to communication with the server apparatus.

In the printing apparatus described above, a display section that performs display relating to an accommodation amount of the printing material accommodated in the printing material accommodation body is further included, and when the accommodation amount of the printing material accommodated in the printing material accommodation body is less than or equal to a specified amount, the control section, in the second mode, does not cause a display section to display the accommodation amount being less than or equal to the specified amount, and, in the first mode, causes the display section to display the accommodation amount being less than or equal to the specified amount.

According to this configuration, when an accommodation amount of a printing material accommodated in a printing material accommodation body is less than or equal to a specified amount, whether or not a display section displays that the accommodation amount is less than or equal to the specified amount can be changed depending on the type of the mode. Therefore, whether or not to note that an accommodation amount is less than or equal to a specified amount can be changed depending on the type of accommodation body information and communication with the server apparatus, and an operation can be performed in a mode suitable for a user.

A printing system is a printing system including a printing apparatus, and a server apparatus configured to communicate with the printing apparatus via a network, in which the printing apparatus includes a printing section that performs printing with a printing material accommodated in a printing material accommodation body, a control section that controls printing of the printing section, and an information acquisition section that acquires accommodation body information on the printing material accommodation body, and in which the control section performs an operation of a first mode when the accommodation body information acquired by the information acquisition section is first information, and performs an operation of a second mode in a case in which a permission condition is satisfied according to communication with the server apparatus when the accommodation body information acquired by the information acquisition section is second information. According to this printing system, the same effects as the effects of the printing apparatus described above are obtained.

In the printing system described above, when the accommodation body information acquired by the information acquisition section is the second information, the control section transmits determination information for determining whether or not the permission condition is satisfied to the server apparatus, and the server apparatus includes a permission condition determination section that determines whether the permission condition is satisfied based on the determination information from the printing apparatus, and a determination result information transmission section that transmits determination result information indicating a result determined by the permission condition determination section, and the control section performs the operation of the second mode when receiving determination result information indicating that the permission condition is satisfied from the server apparatus. According to this printing system, the same effects as the effects of the printing apparatus described above are obtained.

In the printing system described above, when the accommodation body information acquired by the information acquisition section is the second information, the control section requests the server apparatus to transmit determination information for determining whether or not the permission condition is satisfied, and the server apparatus includes a determination information transmission section that transmits the determination information to the printing apparatus when transmission of the determination information is requested from the printing apparatus, and the printing apparatus includes a permission condition determination section that determines whether or not the permission condition is satisfied based on the determination information transmitted from the server apparatus. According to this printing system, the same effects as the effects of the printing apparatus described above are obtained.

In the printing system described above, the printing apparatus includes a mounting section to and from which a liquid accommodation body as the printing material accommodation body is attachable and detachable, and the printing section includes a liquid ejecting head that performs printing by ejecting a liquid as the printing material supplied from the liquid accommodation body mounted on the mounting section. According to this printing system, the same effects as the effects of the printing apparatus described above are obtained.

In the printing system described above, a liquid as the printing material filled in a liquid container is configured to be injected into a liquid accommodation body as the printing material accommodation body, and the printing section includes a liquid ejecting head that performs printing by ejecting a liquid supplied from the liquid accommodation body. According to this printing system, the same effects as the effects of the printing apparatus described above are obtained.

In the printing system described above, the determination information includes authentication information for identifying the accommodation body information, and when the accommodation body information acquired by the information acquisition section is the second information, in a case in which a permission condition based on the authentication information is satisfied, the control section performs an operation of the second mode. According to this printing system, the same effects as the effects of the printing apparatus described above are obtained.

In the printing system described above, the printing apparatus includes a display section that performs display relating to an accommodation amount of the printing material accommodated in the printing material accommodation body, and when the accommodation amount of the printing material accommodated in the printing material accommodation body is less than or equal to a specified amount, the control section, in the second mode, does not cause a display section to display the accommodation amount being less than or equal to the specified amount, and, in the first mode, causes the display section to display the accommodation amount being less than or equal to the specified amount. According to this printing system, the same effects as the effects of the printing apparatus described above are obtained.

What is claimed is:

1. A printing apparatus configured to communicate with a server apparatus via a network, the printing apparatus comprising:

a printing section that performs printing with a printing material accommodated in a printing material accommodation body;

a control section that controls printing of the printing section; and an information acquisition section that acquires accommodation body information on the printing material accommodation body, wherein the control section performs an operation of a first mode when the accommodation body information acquired by the information acquisition section is first information, and performs an operation of a second mode in a case in which a permission condition is satisfied according to communication with the server apparatus when the accommodation body information acquired by the information acquisition section is second information, and wherein the operation of the first mode and the operation of the second mode is a maintenance operation on the printing section, the control section being configured to cause a larger amount of the printing material accommodated in the printing material accommodation body to be used during the maintenance operation of the second mode than is used during the maintenance operation of the first mode.

2. The printing apparatus according to claim 1, wherein when the accommodation body information acquired by the information acquisition section is the second information, the control section transmits determination information for determining whether or not the permission condition is satisfied to the server apparatus, and when determination result information indicating that the permission condition is satisfied is received from the server apparatus, the permission condition is satisfied.

3. The printing apparatus according to claim 2, wherein the determination information includes authentication information for identifying the accommodation body information, and when the accommodation body information acquired by the information acquisition section is the second information, in a case in which a permission condition based on the authentication information is satisfied, the control section performs the operation of the second mode.

4. The printing apparatus according to claim 1, wherein when the accommodation body information acquired by the information acquisition section is the second information, the control section requests the server apparatus to transmit determination information for determining whether or not the permission condition is satisfied, and the control section includes a permission condition determination section that determines whether or not the permission condition is satisfied based on the determination information transmitted from the server apparatus.

5. The printing apparatus according to claim 1, further comprising:

a mounting section configured such that a liquid accommodation body as the printing material accommodation body is attached thereto and detached therefrom, wherein the printing section includes a liquid ejecting head that performs printing by ejecting a liquid as the printing material supplied from the liquid accommodation body mounted on the mounting section.

6. The printing apparatus according to claim 1, wherein a liquid as the printing material filled in a liquid container is configured to be injected into a liquid accommodation body as the printing material accommodation body, and the printing section includes a liquid ejecting head that performs printing by ejecting a liquid supplied from the liquid accommodation body.

7. The printing apparatus according to claim 1 further comprising:

a display section that performs display relating to an accommodation amount of the printing material accommodated in the printing material accommodation body, wherein when the accommodation amount of the printing material accommodated in the printing material accommodation body is less than or equal to a specified amount, the control section, in the second mode, does not cause the display section to display that the accommodation amount is less than or equal to the specified amount, and, in the first mode, causes the display section to display that the accommodation amount is less than or equal to the specified amount.

8. The printing system according to claim 1, wherein the printing material accommodation body that is used during the operation of the first mode is not used during the operation of the second mode, and the printing material accommodation body that is used during the operation of the second mode is not used during the operation of the first mode.

9. A printing system comprising:

a printing apparatus; and a server apparatus configured to communicate with the printing apparatus via a network, wherein the printing apparatus includes a printing section that performs printing with a printing material accommodated in a printing material accommodation body, a control section that controls printing of the printing section, and an information acquisition section that acquires accommodation body information on the printing material accommodation body, and the control section performs an operation of a first mode when the accommodation body information acquired by the information acquisition section is first information, and performs an operation of a second mode in a case in which a permission condition is satisfied according to communication with the server apparatus when the accommodation body information acquired by the information acquisition section is second information, wherein the operation of the first mode and the operation of the second mode is a maintenance operation on the printing section, the control section being configured to cause a larger amount of the printing material accommodated in the printing material accommodation body to be used during the maintenance operation of the second mode than is used during the maintenance operation of the first mode.

10. The printing system according to claim 9, wherein when the accommodation body information acquired by the information acquisition section is the second information, the control section transmits determination information for determining whether or not the permission condition is satisfied to the server apparatus, the server apparatus includes a permission condition determination section that determines whether the permission condition is satisfied based on the determination information from the printing apparatus and a determination result information transmission section that transmits determination result information indicating a result determined by the permission condition determination section, and the control section performs the operation of the second mode when receiving determination result information indicating that the permission condition is satisfied from the server apparatus.

11. The printing system according to claim 9, wherein when the accommodation body information acquired by the information acquisition section is the second information, the control section requests the server apparatus to transmit determination information for determining whether or not the permission condition is satisfied, the server apparatus includes a determination information transmission section that transmits the determination information to the printing apparatus when transmission of the determination information is requested from the printing apparatus, and the printing apparatus includes a permission condition determination section that determines whether or not the permission condition is satisfied based on the determination information transmitted from the server apparatus.

12. The printing system according to claim 9, wherein the printing apparatus includes a mounting section configured such that a liquid accommodation body as the printing material accommodation body is attached thereto and detached therefrom, and the printing section includes a liquid ejecting head that performs printing by ejecting a liquid as the printing material supplied from the liquid accommodation body mounted on the mounting section.

13. The printing system according to claim 9, wherein a liquid as the printing material filled in a liquid container is configured to be injected into a liquid accommodation body as the printing material accommodation body, and the printing section includes a liquid ejecting head that performs printing by ejecting a liquid supplied from the liquid accommodation body.

14. The printing system according to claim 10, wherein the determination information includes authentication information for identifying the accommodation body information, and when the accommodation body information acquired by the information acquisition section is the second information, in a case in which a permission condition based on the authentication information is satisfied, the control section performs the operation of the second mode.

15. The printing system according to claim 9, wherein the printing apparatus includes a display section that performs display relating to an accommodation amount of the printing material accommodated in the printing material accommodation body, and when the accommodation amount of the printing material accommodated in the printing material accommodation body is less than or equal to a specified amount, the control section, in the second mode, does not cause the display section to display that the accommodation amount is less than or equal to the specified amount, and, in the first mode, causes the display section to display that the accommodation amount is less than or equal to the specified amount.

16. A printing apparatus configured to communicate with a server apparatus via a network, the printing apparatus comprising:

a printing section that performs printing with a printing material accommodated in a plurality of printing material accommodation bodies;

a control section that controls printing of the printing section; and an information acquisition section that acquires accommodation body information on each of the plurality of printing material accommodation bodies, wherein the control section performs an operation of a first mode when the accommodation body information on each of the plurality of printing material accommodation bodies acquired by the information acquisition section is first information, and performs an operation of a second mode in a case in which a permission condition is satisfied according to communication with the server apparatus when second information is included in the accommodation body information on each of the plurality of printing material accommodation bodies acquired by the information acquisition section.

* * * * *